US009347730B2

(12) United States Patent
Obteshka

(10) Patent No.: US 9,347,730 B2
(45) Date of Patent: May 24, 2016

(54) ADJUSTABLE PULLEY ASSEMBLY FOR A COMPOUND ARCHERY BOW

(71) Applicant: BowTech, Inc., Eugene, OR (US)

(72) Inventor: Nicholas C. Obteshka, Springfield, OR (US)

(73) Assignee: BOWTECH, INC., Eugene, OR (US)

( * ) Notice: Subject to any disclaimer, the term of this patent is extended or adjusted under 35 U.S.C. 154(b) by 165 days.

(21) Appl. No.: 14/318,640

(22) Filed: Jun. 28, 2014

(65) Prior Publication Data

US 2015/0377581 A1 Dec. 31, 2015

(51) Int. Cl.
*F41B 5/10* (2006.01)
*F41B 5/14* (2006.01)

(52) U.S. Cl.
CPC . *F41B 5/105* (2013.01); *F41B 5/10* (2013.01); *F41B 5/1403* (2013.01)

(58) Field of Classification Search
None
See application file for complete search history.

(56) References Cited

U.S. PATENT DOCUMENTS 4,519,374 A * 5/1985 Miller ..... F41B 5/10 124/25.6
4,562,824 A 1/1986 Jennings
4,660,536 A 4/1987 McPherson
4,926,832 A 5/1990 Darlington
4,976,250 A 12/1990 Jeffrey
5,678,529 A 10/1997 Larson
5,782,229 A 7/1998 Evans et al.
5,960,778 A 10/1999 Larson
6,067,974 A 5/2000 Islas
6,082,347 A 7/2000 Darlington
6,112,732 A * 9/2000 Larson ..... F41B 5/10 124/25.6
6,155,243 A 12/2000 Gallops, Jr.
6,250,293 B1 * 6/2001 Andrews ..... F41B 5/10 124/25.6
RE37,544 E 2/2002 Darlington
6,446,619 B1 9/2002 McPherson
6,460,528 B1 10/2002 Gallops, Jr.
6,474,324 B1 11/2002 Despart et al.
6,516,790 B1 2/2003 Darlington
6,575,153 B2 6/2003 Lommasson et al.
6,718,963 B1 4/2004 Wheeler
6,792,930 B1 9/2004 Kronengold et al.
6,871,643 B2 3/2005 Cooper et al.
6,966,312 B1 11/2005 Larson
6,976,484 B1 12/2005 Gallops, Jr.
6,990,970 B1 1/2006 Darlington
7,082,937 B1 * 8/2006 Land ..... F41B 5/105 124/25.6
7,305,979 B1 12/2007 Yehle
7,311,098 B2 12/2007 Gallops, Jr.
7,673,626 B1 3/2010 Hennings
7,690,372 B2 4/2010 Cooper et al.
7,721,721 B1 * 5/2010 Kronengold ..... F41B 5/105 124/16
7,770,568 B1 8/2010 Yehle
8,020,544 B2 9/2011 McPherson et al.
8,082,910 B1 * 12/2011 Yehle ..... F41B 5/105 124/23.1
8,205,607 B1 * 6/2012 Darlington ..... F41B 5/105 124/23.1

(Continued)

*Primary Examiner* — Melba Bumgarner
*Assistant Examiner* — Amir Klayman
(74) *Attorney, Agent, or Firm* — David S. Alavi

(57) ABSTRACT

A pulley assembly for a compound bow comprises a draw cable pulley rotatable about a first axis, a mounting member attached to the draw cable pulley and adjustable among multiple positions, and a power cable pulley attached to the mounting member and adjustable among multiple positions about a second axis. Movement of the mounting member shifts the second axis relative to the first axis. Movement of one or both of the mounting member or power cable pulley alters one or more of the bow's draw force curve, draw length, draw weight, or stored energy.

29 Claims, 13 Drawing Sheets

(56) References Cited

U.S. PATENT DOCUMENTS

| | | | | |
|---|---|---|---|---|
| 8,469,013 | B1 * | 6/2013 | Obteshka | F41B 5/10 124/23.1 |
| 8,683,989 | B1 * | 4/2014 | McPherson | F41B 5/10 124/25.6 |
| 9,121,658 | B1 * | 9/2015 | Darlington | F41B 5/105 |
| 2002/0144675 | A1 | 10/2002 | Lommasson et al. | |
| 2004/0003806 | A1 | 1/2004 | Blahnik | |
| 2004/0074485 | A1 | 4/2004 | Cooper et al. | |
| 2005/0193998 | A1 | 9/2005 | Cooper et al. | |
| 2005/0268892 | A1 | 12/2005 | Gallops | |
| 2006/0000463 | A1 | 1/2006 | Gallops | |
| 2009/0188482 | A1 | 7/2009 | Strother | |
| 2010/0051005 | A1 | 3/2010 | Wilson | |

* cited by examiner 150
156
152
105

150
152
152
157

156
152
105
157
150

130
134
136
137
136
134
105

130
133
133

134
136
133
105
133
136
137
134
130

ADJUSTABLE PULLEY ASSEMBLY FOR A COMPOUND ARCHERY BOW

BACKGROUND

The field of the present invention relates to a pulley assembly for a compound archery bow. In particular, an adjustable pulley assembly is disclosed herein having an adjustable power cable pulley mounted on a draw cable pulley for providing adjustment of one or more of draw length, draw weight, stored energy, or draw force curve.

Several adjustable pulley assemblies are available for compound archery bows. Two such examples are described in: U.S. Pat. No. 8,020,544 entitled "Archery bow with force vectoring anchor" issued Sep. 20, 2011 to McPherson; and U.S. Pat. No. 8,082,910 entitled "Pulley assembly for a compound archery bow" issued Dec. 27, 2011 to Yehle.

SUMMARY

A pulley assembly for a compound archery bow comprises a draw cable pulley, a mounting member substantially rigidly attached to the draw cable pulley, and a power cable pulley substantially rigidly attached to the mounting member. The draw cable pulley (i) defines a first pulley assembly transverse rotation axis, (ii) is mounted on a first limb of an archery bow to rotate about the first pulley assembly axis, (iii) receives a first end of a draw cable of the bow in a circumferential draw cable journal, and (iv) lets out the first end of the draw cable when the bow is drawn and the draw cable pulley rotates about the first pulley assembly axis. The mounting member is substantially rigidly attached to the draw cable pulley in any one of a set of multiple mounting member positions. The power cable pulley is substantially rigidly attached to the mounting member in any one of a set of multiple power cable pulley rotational positions that define a power cable pulley rotation axis substantially parallel to the first pulley assembly rotation axis. The power cable pulley member (i) receives a power cable of the bow in a circumferential power cable journal, and (ii) takes up the power cable when the bow is drawn and the draw cable pulley rotates about the first pulley assembly axis. Each different position of the mounting member results in a corresponding different position of the power cable pulley rotation axis relative to the first pulley assembly rotation axis.

Each combination of one of the mounting member positions and one of the power cable pulley rotational positions results in one or more of: (i) a corresponding draw length of the bow that differs from a draw length resulting from at least one different combination of mounting member position and power cable pulley rotational position; (ii) a corresponding draw weight of the bow that differs from a draw weight resulting from at least one different combination of mounting member position and power cable pulley rotational position; (iii) corresponding stored energy of the drawn bow that differs from stored energy of the drawn bow resulting from at least one different combination of mounting member position and power cable pulley rotational position; or (iv) a corresponding dependence of draw force on draw distance of the bow that differs from a dependence of draw force on draw distance resulting from at least one different combination of mounting member position and power cable pulley rotational position.

A method for adjusting the pulley assembly described above comprises (i) moving the mounting member from one mounting member position to another, or (ii) moving the power cable pulley from a first power cable pulley rotational position to another. Those one or more movements result in alteration of one or more of the draw weight, the draw length, the stored energy of the drawn bow, or the dependence of draw force on draw distance.

An archery bow comprises a central riser, first and second bow limbs secured to opposing ends of the riser, first and second pulley assemblies rotatably mounted on the first and second bow limbs, respectively, a draw cable and a power cable. One or both of the pulley assemblies is arranged as described above.

Objects and advantages pertaining to pulley assemblies for compound bows may become apparent upon referring to the example embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It should be noted that the embodiments depicted are shown only schematically, and that not all features may be shown in full detail or in proper proportion. Certain features or structures may be exaggerated relative to others for clarity.

It should be noted further that the embodiments shown are examples only, and should not be construed as limiting the scope of the present disclosure or appended claims.

DETAILED DESCRIPTION OF EMBODIMENTS

Figure 1:
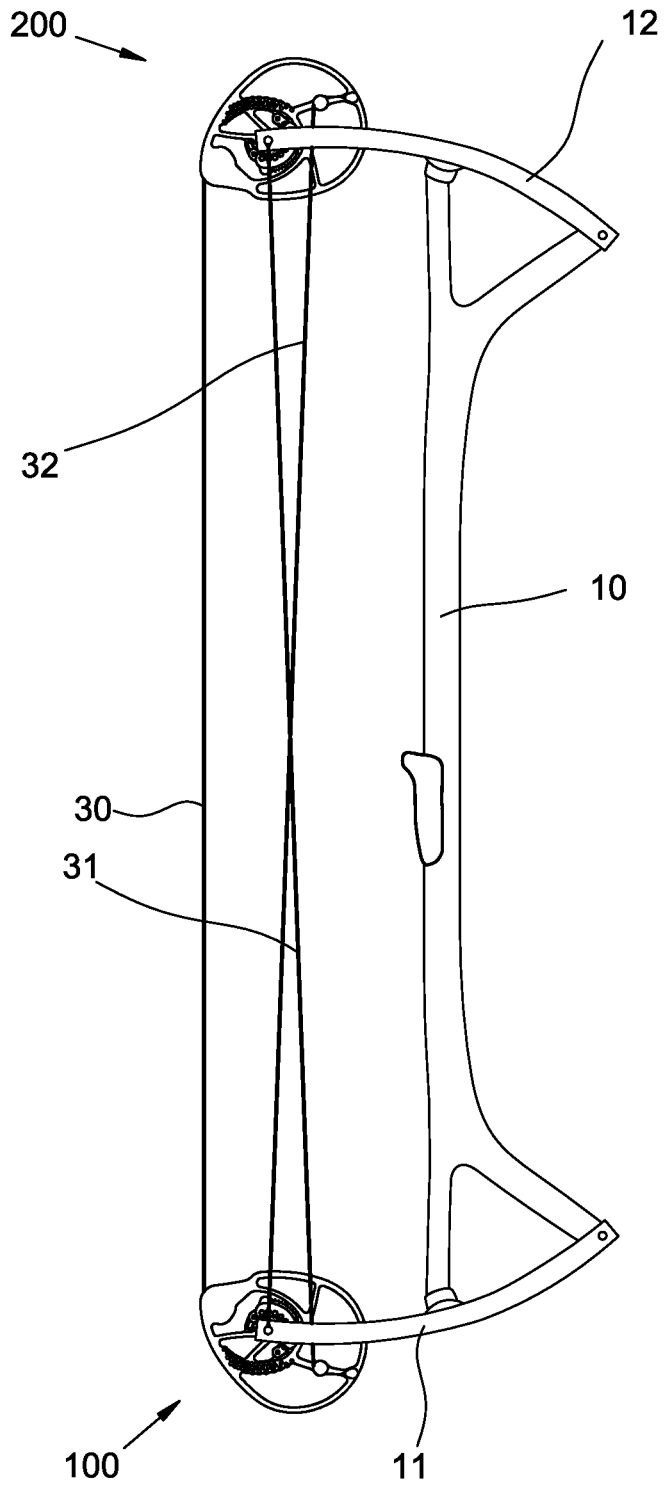
FIG. 1 illustrates schematically an example of a so-called dual cam archery bow.
Figure 2:
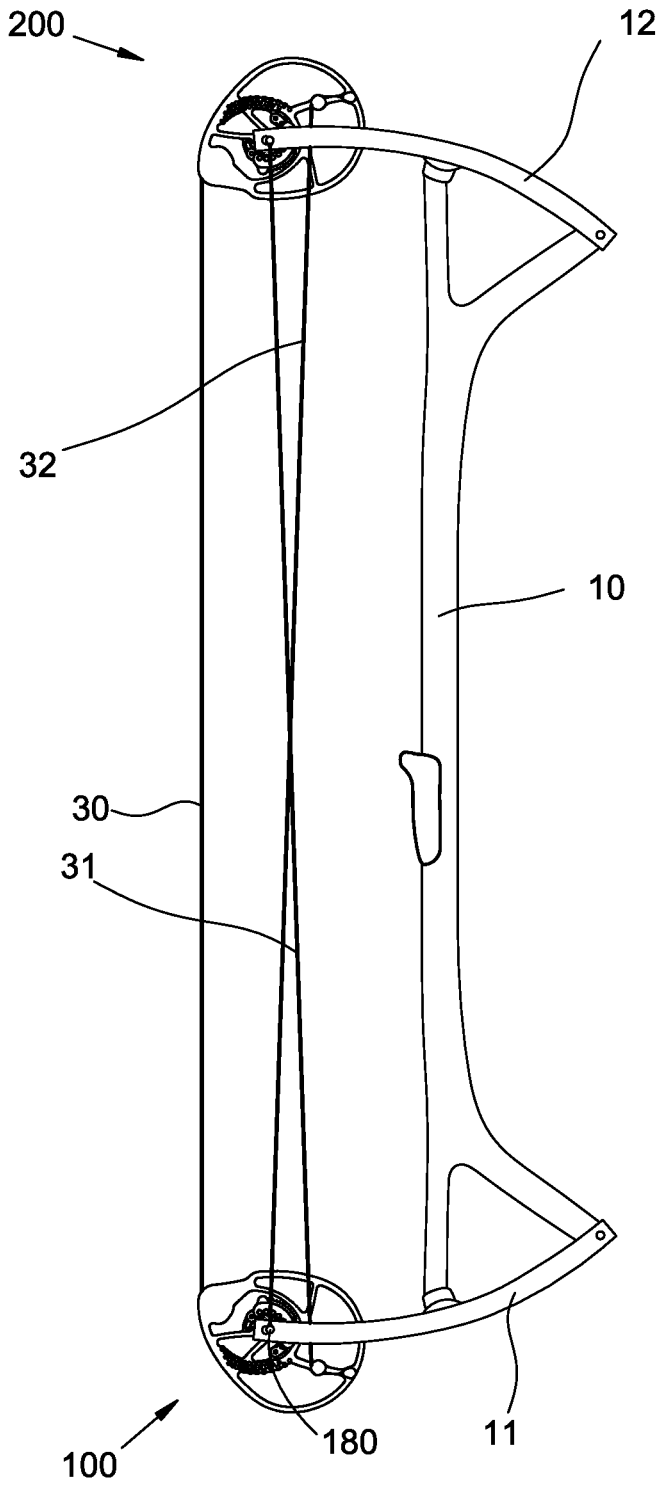
FIG. 2 illustrates schematically an example of a so-called binary cam archery bow.

A compound archery bow comprises a central riser 10, first and second bow limbs 11 and 12 secured to opposing ends of the riser 10, first and second pulley assemblies 100 and 200 rotatably mounted on the first and second bow limbs 11 and 12, respectively, a draw cable 30, and a power cable 31. If the bow is a so-called dual cam bow (FIG. 1) or a so-called binary cam bow (FIG. 2), then the bow includes a second power cable 32 and the first and second pulley assemblies 100 and 200 are substantially identical or substantial mirror images of each other. Upon drawing a dual cam bow, the draw cable 30 is let out by both pulley assemblies 100 and 200, the power cable 31 (which is attached, directly or indirectly, to the second bow limb 12) is taken up by the first pulley assembly 100, and the second power cable 32 (which is attached, directly or indirectly, to the first bow limb 11) is taken up by the second pulley assembly 200. Upon drawing a binary cam bow, the draw cable 30 is let out by both pulley assemblies 100 and 200, the power cable 31 is let out by the second pulley assembly 200 and taken up by the first pulley assembly 100, and the second power cable 32 is let out by the first pulley assembly 100 and taken up by the second pulley assembly 200.

Figure 3:
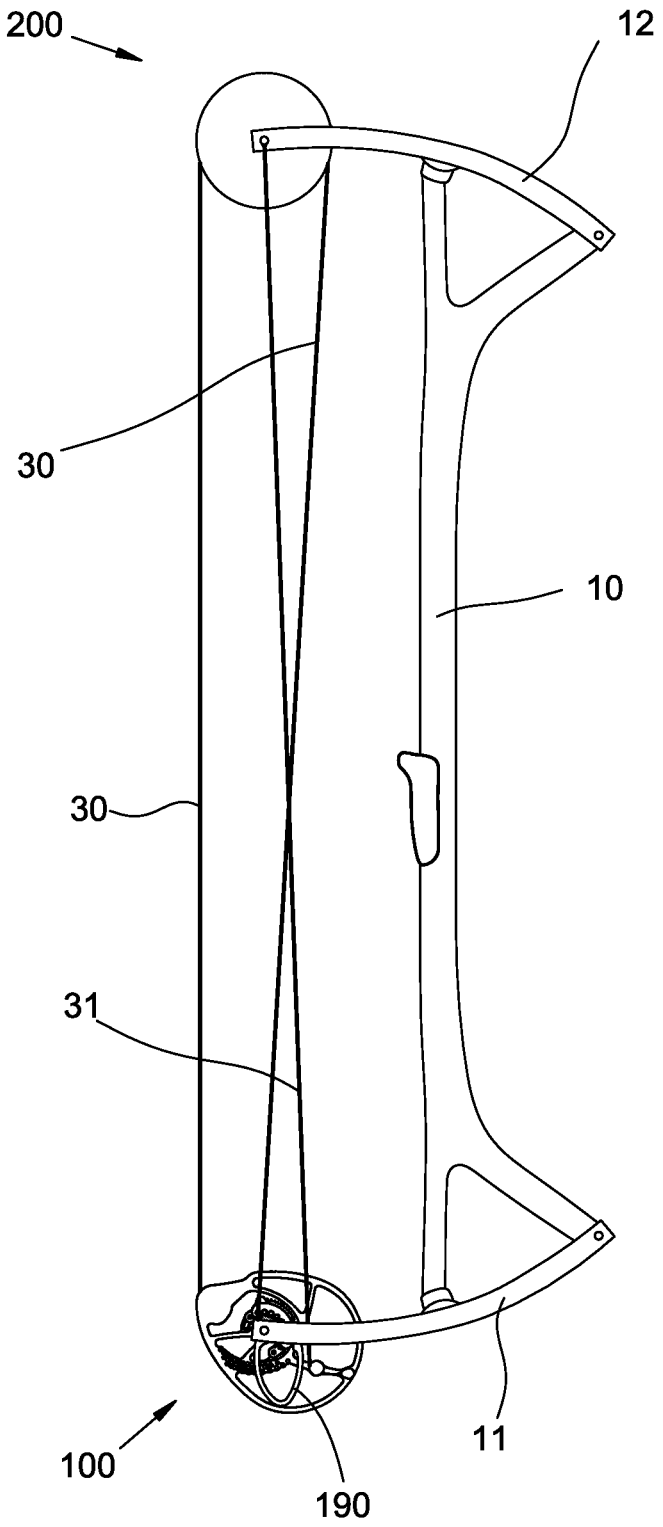
FIG. 3 illustrates schematically an example of a so-called solo cam archery bow.
Figure 4:
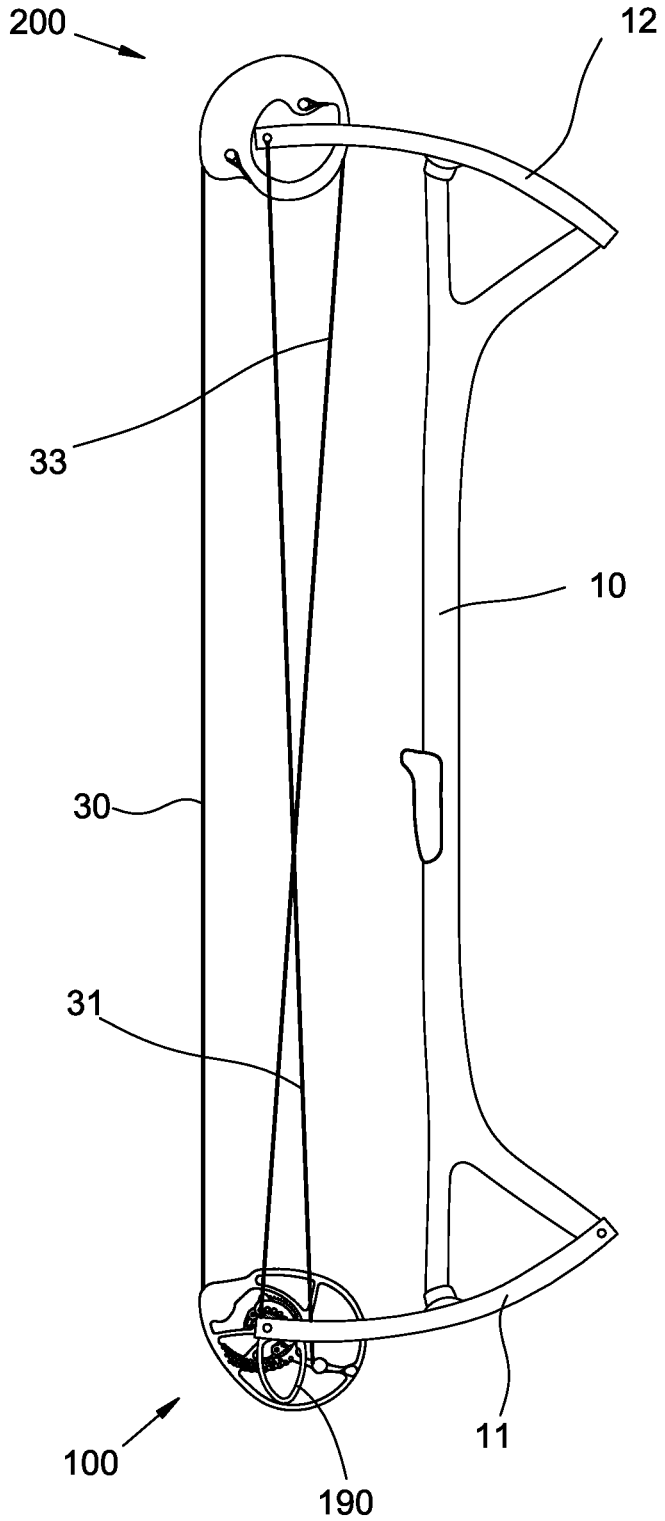
FIG. 4 illustrates schematically an example of a so-called hybrid cam archery bow.
Figure 5A:
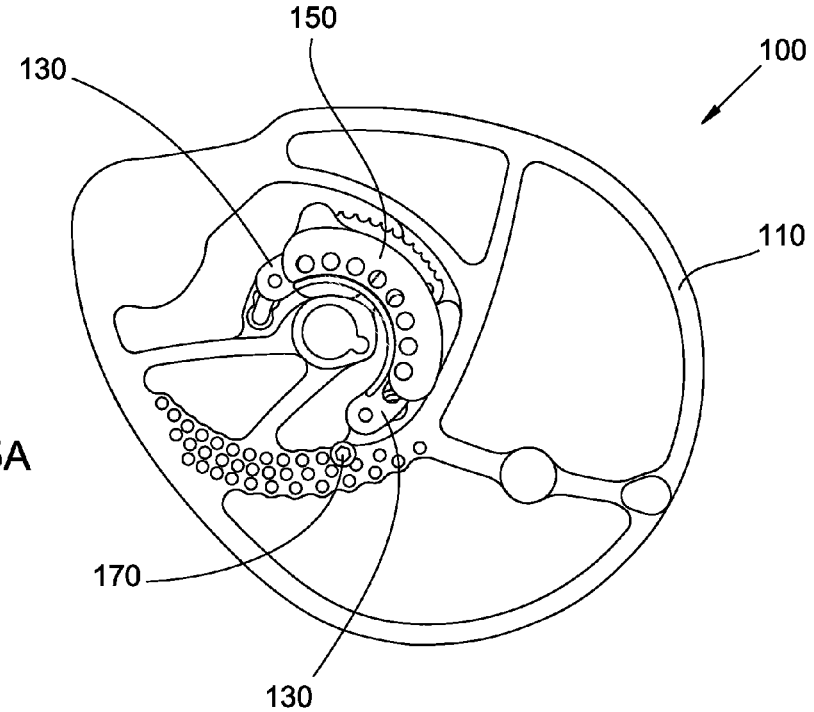
FIGS. 5A and 5B are schematic right and left side views, respectively, of an example inventive pulley assembly in a first example arrangement.
Figure 5B:
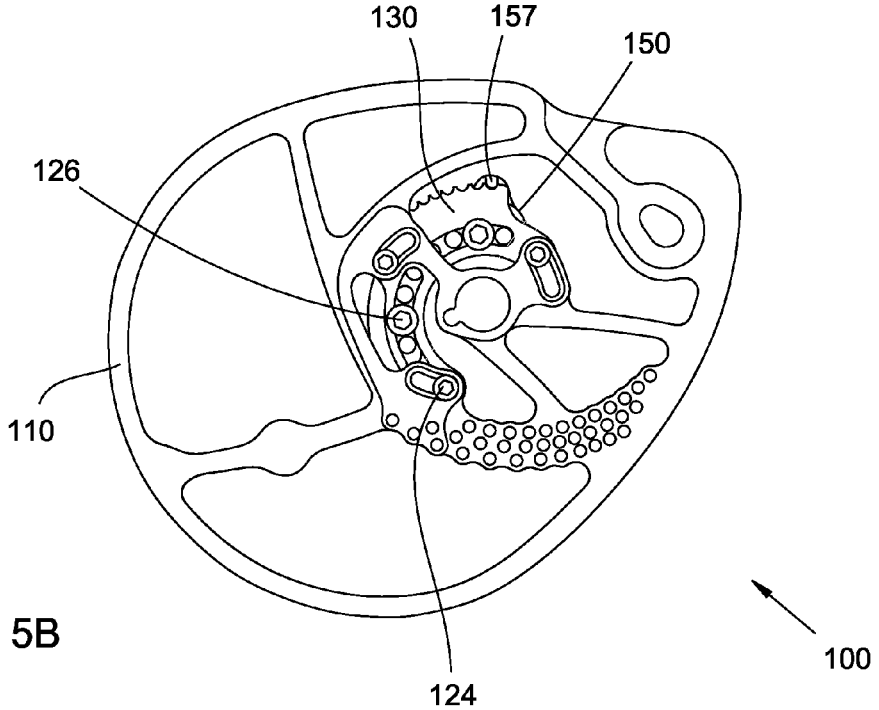
Figure 6A:
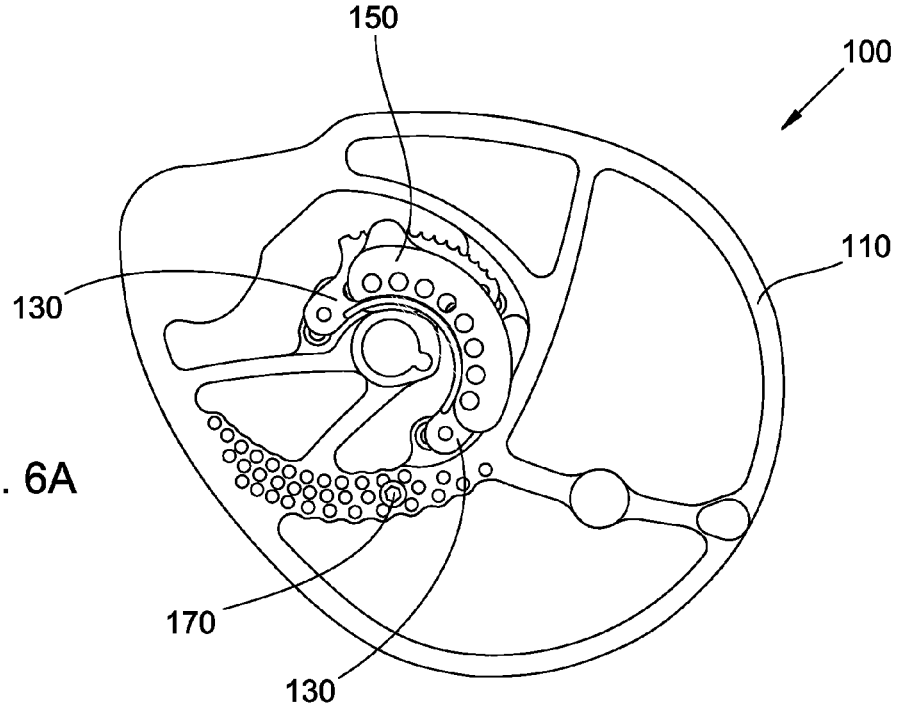
FIGS. 6A and 6B are schematic right and left side views, respectively, of an example inventive pulley assembly in a second example arrangement.
Figure 6B:
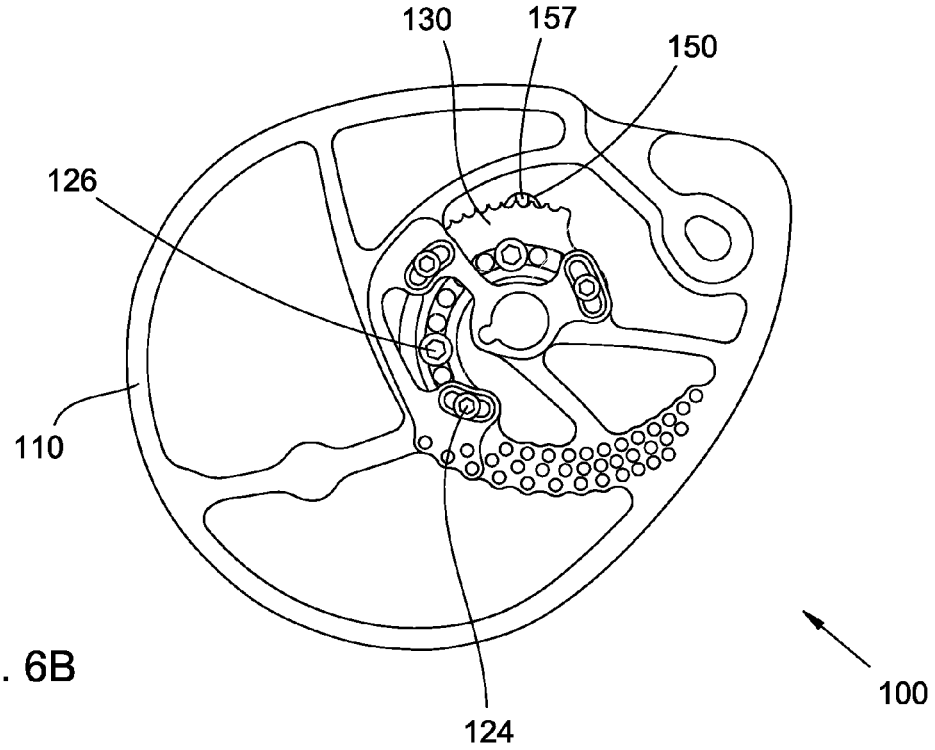
Figure 7A:
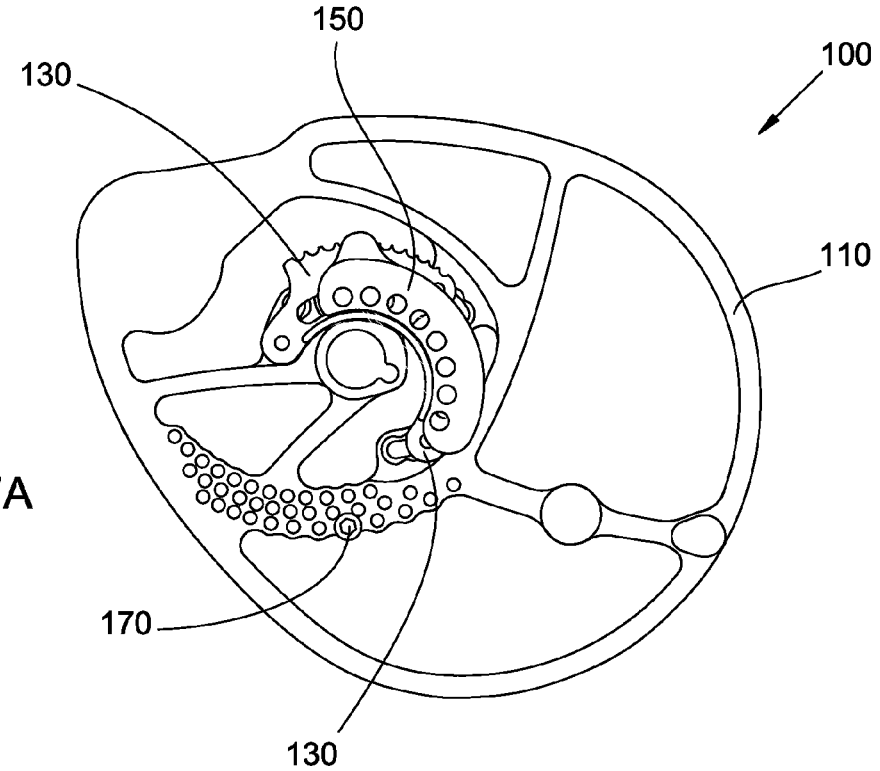
FIGS. 7A and 7B are schematic right and left side views, respectively, of an example inventive pulley assembly in a third example arrangement.
Figure 7B:
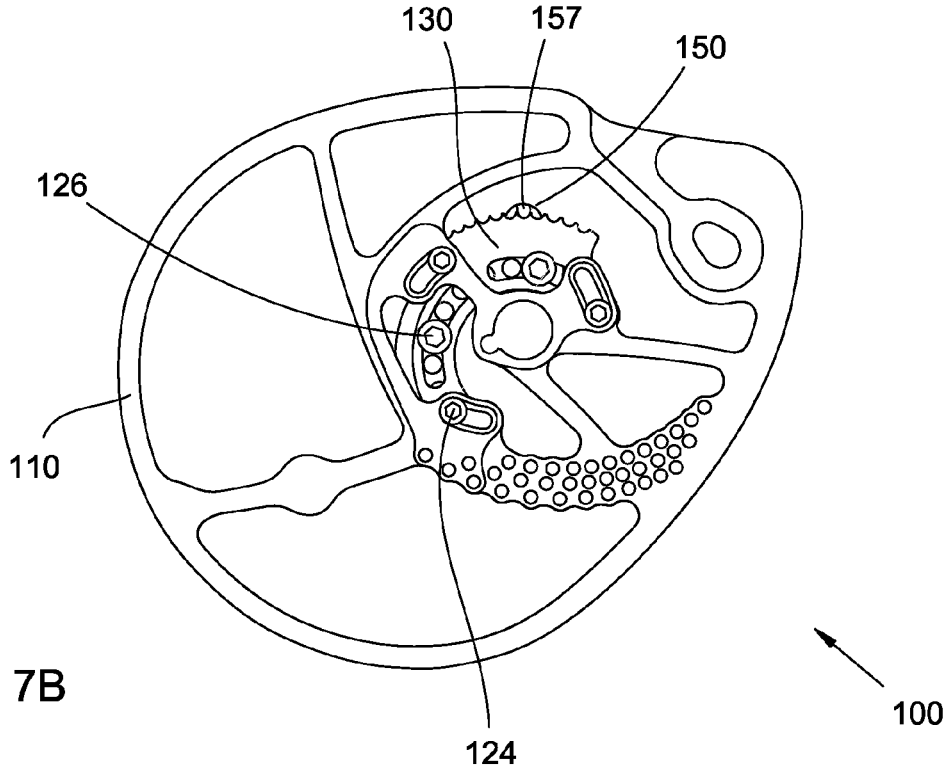

If the bow is a so-called solo cam bow (FIG. 3), then the second pulley assembly 200 comprises an idler wheel and the draw cable 30 passes around the idler wheel and is connected at both ends to the first pulley assembly 100. Upon drawing a solo cam bow, both ends of the draw cable are let out by the first pulley assembly 100. The power cable 31 is taken up at its first end by the first pulley assembly 100; the second end of the power cable 31 typically is attached, directly or indirectly, to the second bow limb 12; in some examples the power cable 31 instead can be let out by the second pulley assembly 200. If the bow is a so-called hybrid cam bow (FIG. 4), then the bow includes an additional coupling cable 33 connected to the first and second pulley members 100 and 200. Upon drawing a hybrid cam bow, the draw cable 30 is let out by both pulley assemblies 100 and 200 and the coupling cable 33 is let out by the first pulley assembly 100 and taken up by the second pulley assembly 200. The power cable 31 is taken up at its first end by the first pulley assembly 100; the second end of the power cable 31 typically is attached, directly or indirectly, to the second bow limb 12; in some examples the power cable 31 instead can be let out by the second pulley assembly 200.

The inventive pulley assemblies disclosed herein, or equivalents thereof, can be advantageously employed with any type of compound archery bow, including dual cam, binary cam, solo cam, and hybrid cam bows described above. In a dual or binary cam bow, inventive pulley assemblies can be employed for both pulley assemblies; in a solo or hybrid cam bow, an inventive pulley assembly can be employed for only one pulley assembly.

Figure 8A:
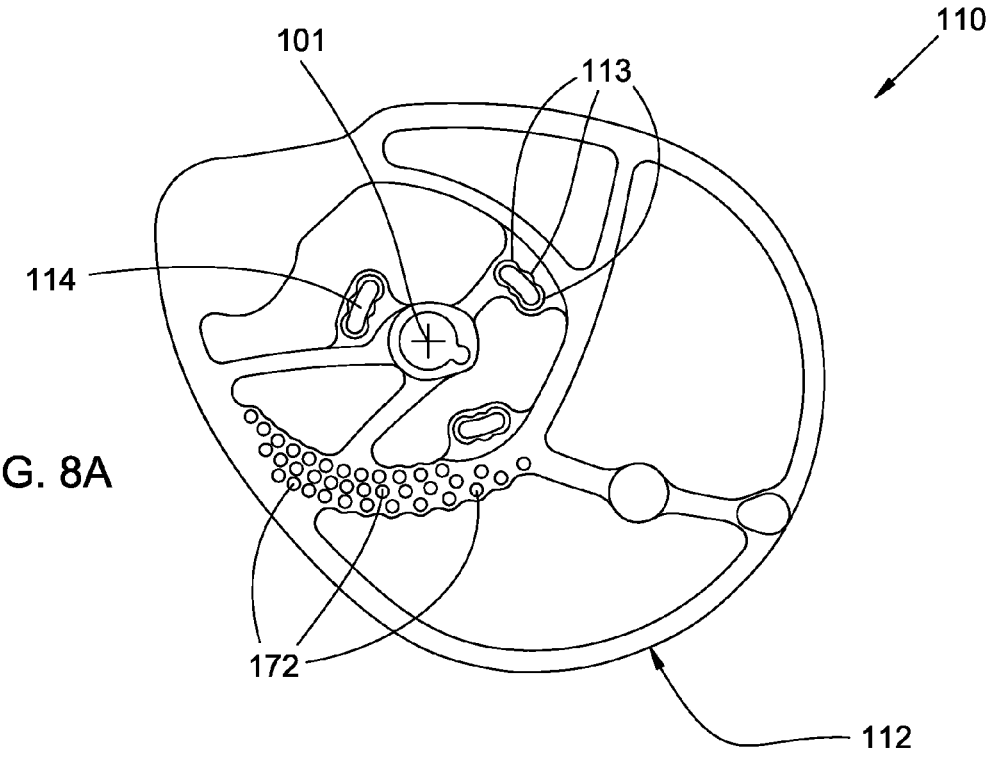
FIGS. 8A and 8B are schematic right side and left side views, respectively, of the draw cable pulley of the example pulley assembly of FIGS. 5A-7B.
Figure 8B:
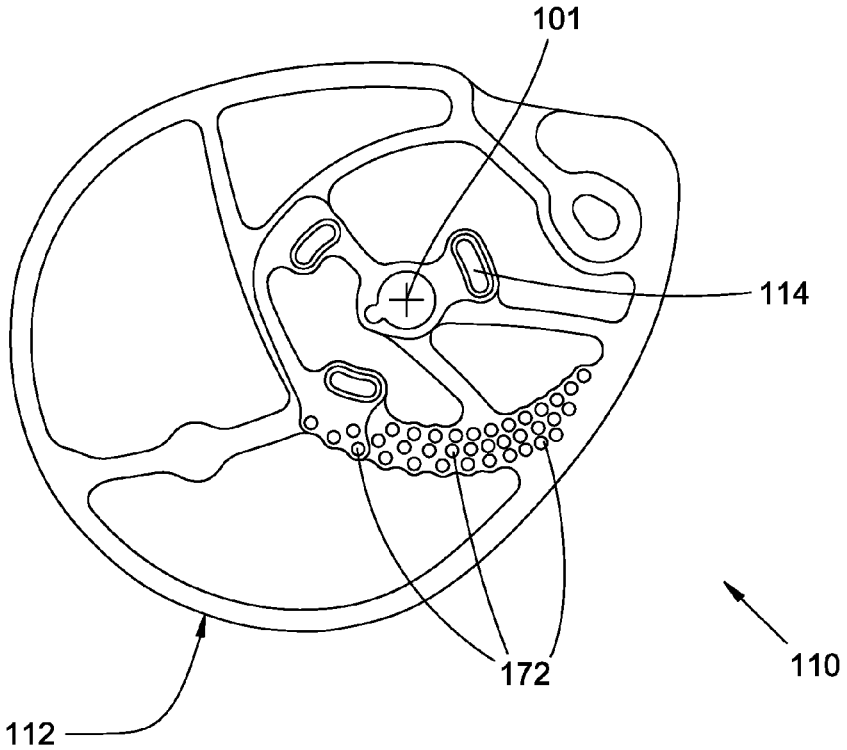
Figures 9A, 9B, 9C, 10A, 10B, 10C:
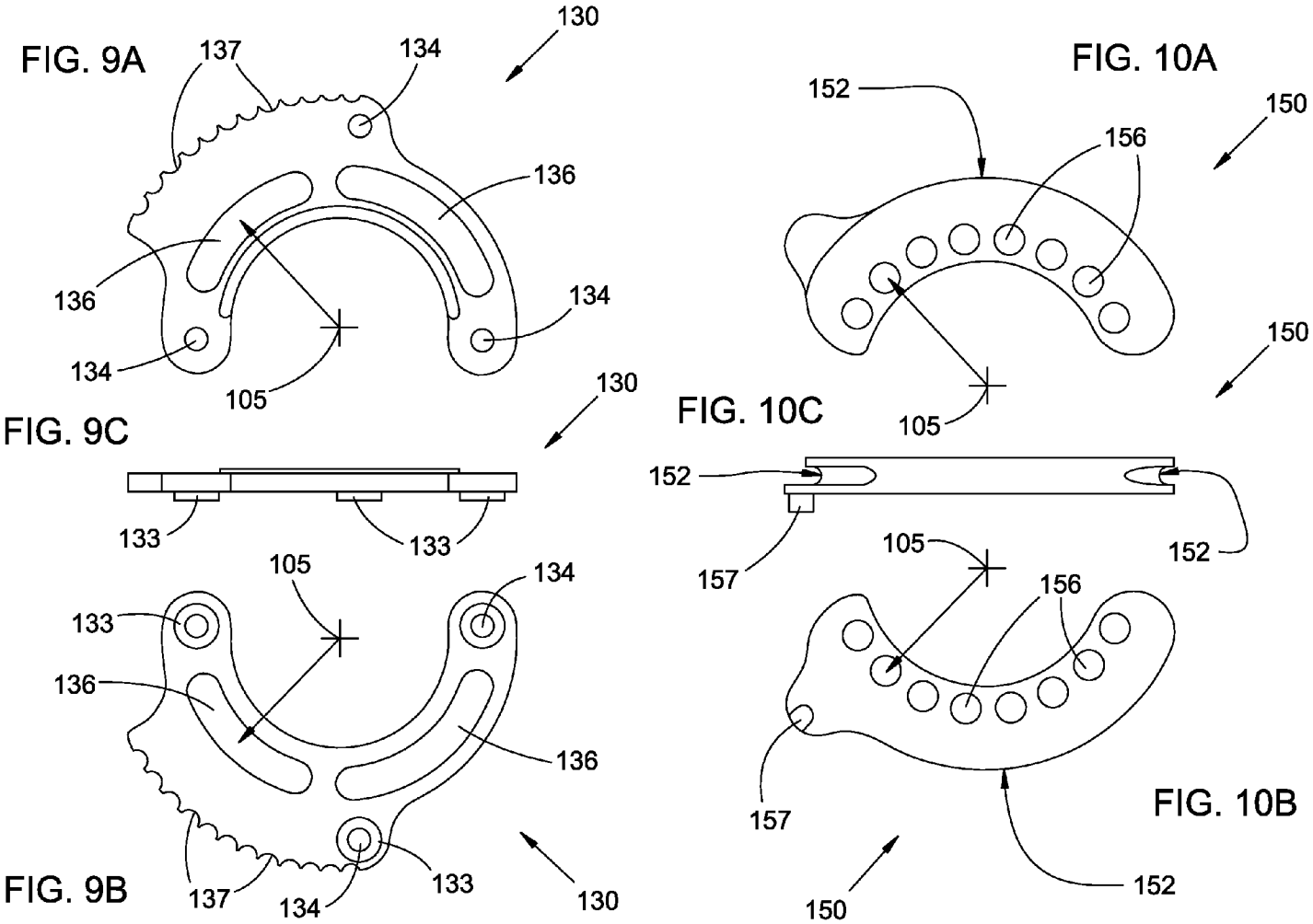
FIGS. 9A-9C are enlarged, schematic right side, left side, and edge views, respectively, of the mounting member of the example pulley assembly of FIGS. 5A-7B.
FIGS. 10A-10C are enlarged, schematic right side, left side, and edge views, respectively, of the power cable pulley of the example pulley assembly of FIGS. 5A-7B.
Figure 11A:
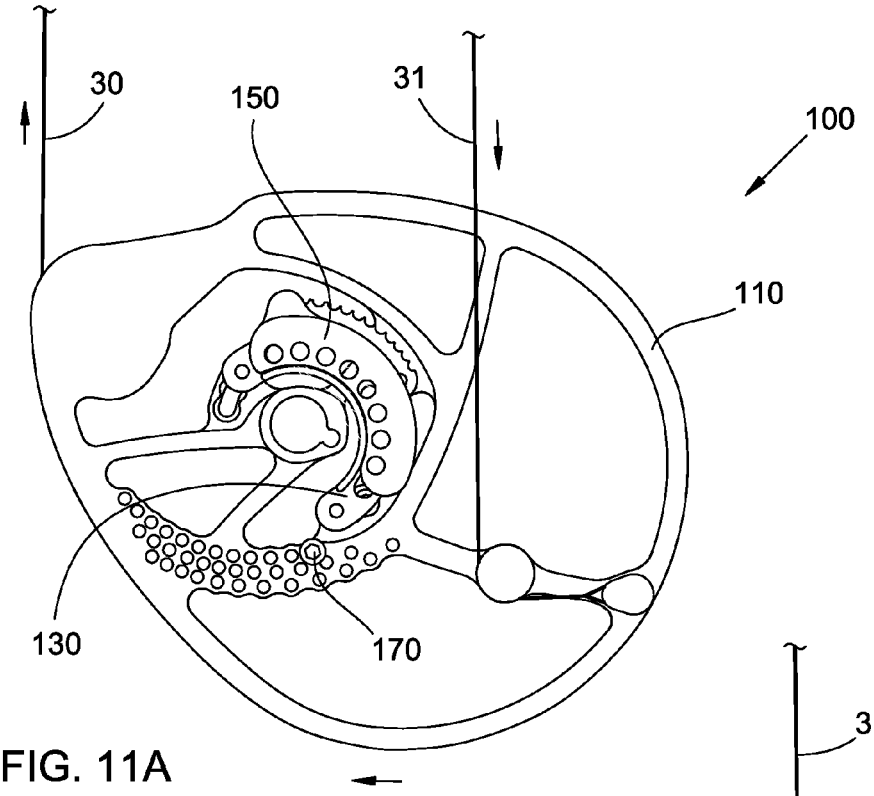
FIGS. 11A and 11B are schematic right side views of the example pulley assembly arranged as in FIGS. 5A and 5B at brace and at full draw, respectively.
Figure 11B:
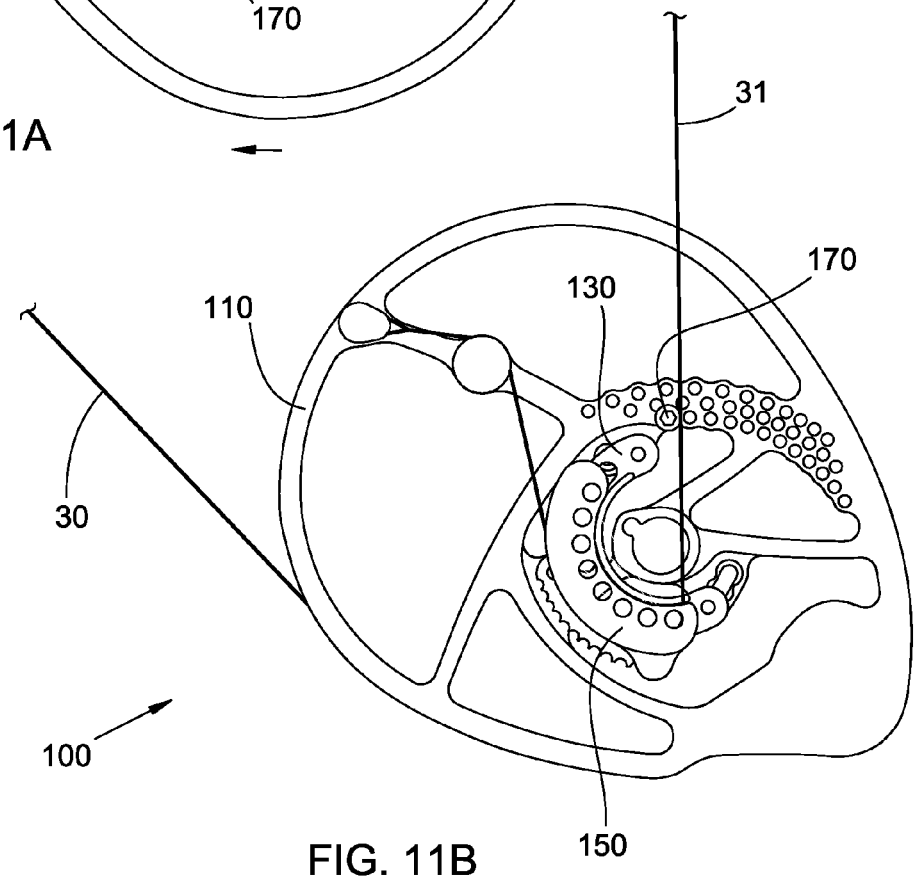
Figure 12A:
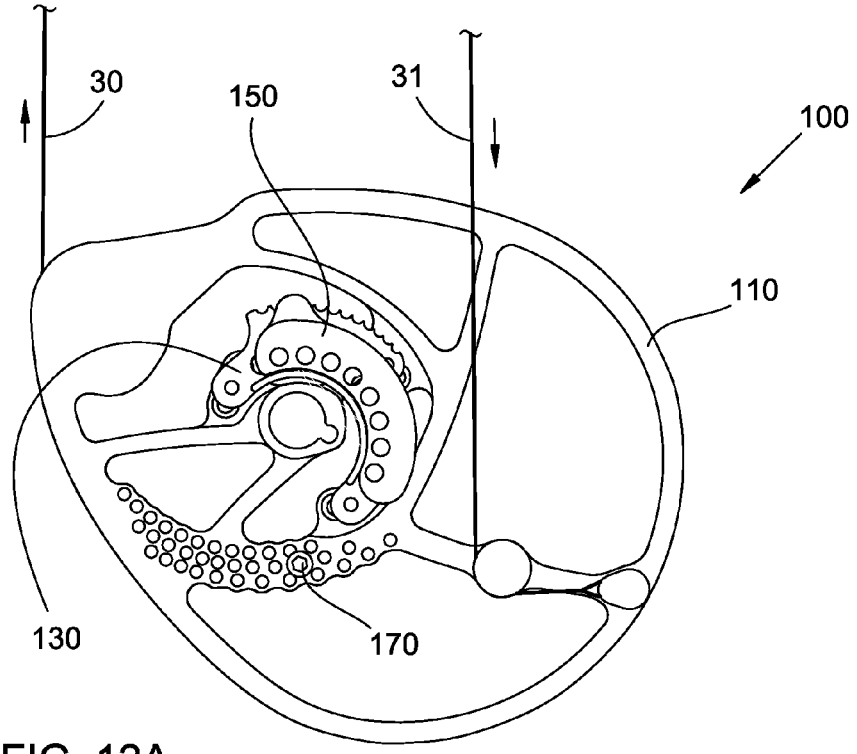
FIGS. 12A and 12B are schematic right side views of the example pulley assembly arranged as in FIGS. 6A and 6B at brace and at full draw, respectively.
Figure 12B:
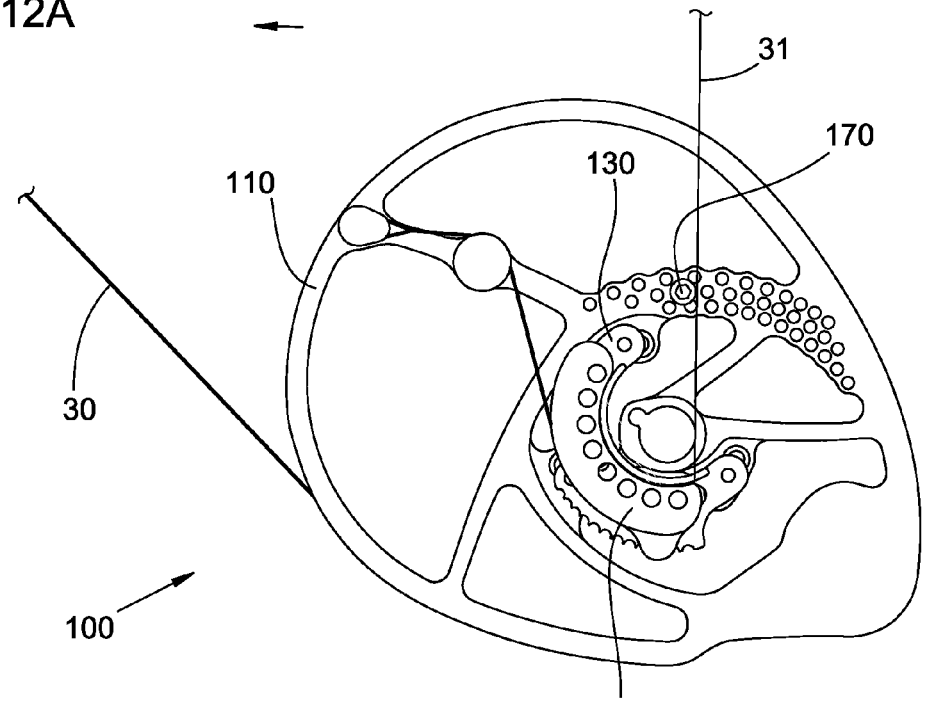
Figure 13A:
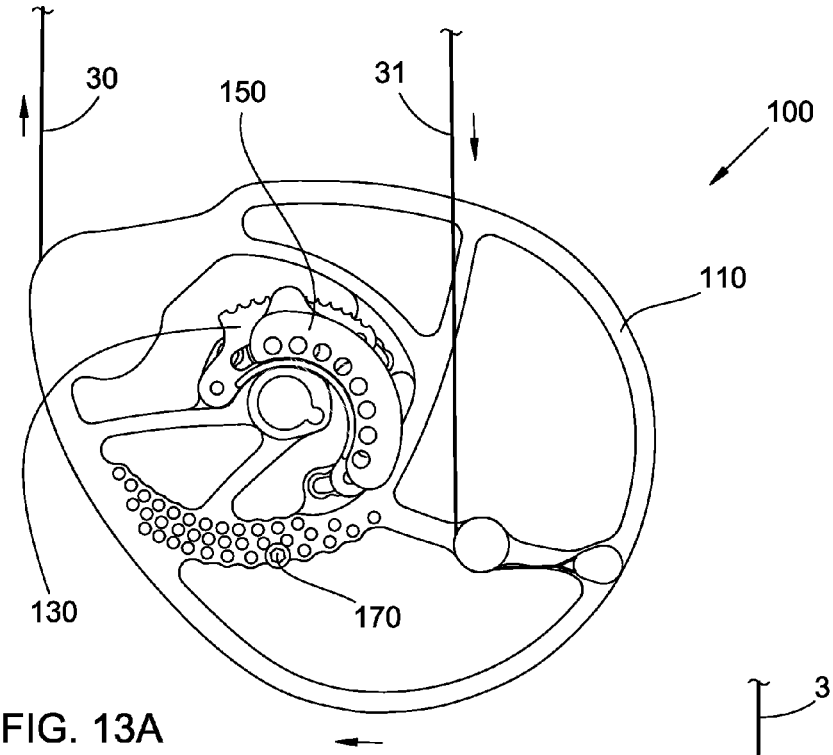
FIGS. 13A and 13B are schematic right side views of the example pulley assembly arranged as in FIGS. 7A and 7B at brace and at full draw, respectively.
Figure 13B:
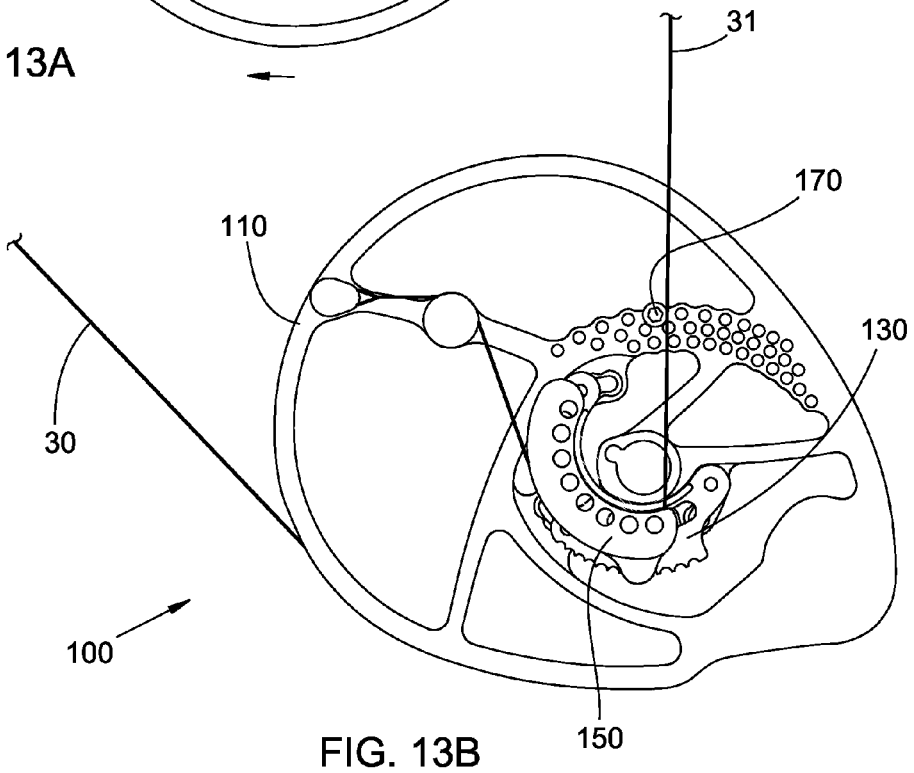

An example of an inventive pulley assembly 100 is shown in FIGS. 5A-7B and 11A-13B. As noted above, the pulley assembly 200 in a dual or hybrid cam bow can be substantially identical or a substantial mirror image of the pulley assembly 100, and the following description can apply to both pulley assemblies 100 and 200 in such cases. The pulley assembly 100 comprises a draw cable pulley 110 (FIGS. 8A and 8B), a mounting member 130 (FIGS. 9A and 9C) substantially rigidly attached to the draw cable pulley 110, and a power cable pulley 150 (FIGS. 10A and 10C) substantially rigidly attached to the mounting member 130. Each of those elements can be fabricated in any suitable way from any one or more suitably strong and rigid materials; such elements are commonly fabricated by machining from aluminum; other materials or fabrication methods can be employed. The draw cable pulley 110 defines a first pulley assembly transverse rotation axis 101 and is mounted on the limb 11 in any suitable manner to rotate about the first pulley assembly axis 101. "Transverse" in the context of the present disclosure refers to a direction that is substantially perpendicular to a virtual plane in which the draw cable 30 moves as the bow is drawn; the first pulley assembly axis 101 is substantially perpendicular to that draw cable plane. Suitable mounting arrangements can include one or more of, e.g., an axle passing through the draw cable pulley 110, one or more axle segments integrally formed on the draw cable pulley 110, rotational bearings on the draw cable pulley 110 or on the limb 11, and so on; some examples are disclosed by U.S. Pat. Nos. 8,469,013 and 8,739,769, which are incorporated by reference. The draw cable pulley 110 includes a circumferential draw cable journal or groove 112 arranged around at least a portion of its periphery. A first end of the draw cable 30 is secured to the draw cable pulley 110 and received in the draw cable journal 112. The draw cable pulley 110 lets out the first end of the draw cable 30 from the draw cable journal 112 when the bow is drawn and the draw cable pulley 110 rotates about the first pulley assembly axis 101. The draw cable pulley 110 can be eccentrically mounted (relative to the first pulley assembly axis 101) or non-circular so as to act as a cam as it lets out the draw cable 30.

One or both of the draw cable pulley 110 and the mounting member 130 are structurally arranged so as to enable substantially rigid attachment of the mounting member 130 to the draw cable pulley 110 in any one of a set of multiple mounting member positions. The structural arrangement of the draw cable pulley 110 and the mounting member 130 can be achieved in any suitable way. In the example in the drawings, three short slots 114 are formed in the draw cable pulley 110 and three corresponding threaded holes 134 are formed in the mounting member 130; other suitable numbers, shapes, or arrangements of slots 114 and corresponding holes 134 can be employed. Screws 124 are inserted through the slots 114, threaded into holes 134, and tightened to substantially rigidly attach the mounting member 130 to the draw cable pulley 110. With the screws 124 loosened, the mounting member 130 can be moved among multiple mounting member positions, and then secured in any selected one of those mounting member positions by tightening the screws 124. The combination of slots 114, threaded holes 134, and screws 124 is only one example of attachment of the mounting member 130 to the draw cable pulley 110; any other suitable structural arrangement for achieving substantially rigid attachment of the mounting member 130 to the draw cable pulley 110 in any one of multiple mounting member positions can be employed within the scope of the present disclosure or appended claims.

In some examples (not shown), the slots 114 can be arranged so that the set of multiple mounting member positions is a continuous range of positions of the mounting member 130 on the draw cable pulley 110. In other examples, including the example shown in the drawings, the set of multiple mounting member positions can comprise a set of discrete positions of the mounting member 130 on the draw cable pulley 110. In the example shown, each of the slots 114 of the draw cable pulley 110 is counterbored on the side of the draw cable pulley 110 facing the attached mounting member 130; the counterbore of each slot 114 has three widened portions 113 separated by intervening narrow portions. Each threaded hole 134 of the mounting member 130 has a protruding boss 133 that can fit into a widened portion 113 of the counterbore of slot 114 but cannot fit into the narrow portions. As a result, the mounting member 130 can be attached to the draw pulley 110 in any one of only three discrete positions. Fitting each boss 133 into one of the three widened portions 113 of the counterbore of the corresponding slot 114 enables the mounting member 130 and the draw cable pulley 110 to engage each other to provide mechanical indexing in each one of the three discrete mounting member positions. The draw cable pulley 110 or the mounting member 130 can be arranged to permit any desired number of discrete positions of the mounting member 130 on the draw cable pulley 110. Any other suitable structural arrangement for providing mechanical indexing of the set of discrete positions of the mounting member 130 can be employed within the scope of the present disclosure or appended claims (e.g., a set of isolated clearance holes through draw cable pulley 110 instead of slots 114).

The power cable pulley 150 is substantially rigidly attached to the mounting member 130. The power cable pulley 150 has a circumferential power cable journal or groove 152 arranged around at least a portion of its periphery. The power cable pulley 150 is structurally arranged so as to receive the power cable 31 in the circumferential power cable journal 152 and to take up the power cable 31 when the bow is drawn and the draw cable pulley 110 rotates about the first pulley assembly axis 101. The power cable pulley 150 typically is eccentrically mounted (relative to the first pulley assembly axis 101) or non-circular so as to act as a cam as it takes up the power cable 31. Some examples of suitable arrangements are disclosed in U.S. Pat. Nos. 7,305,979; 7,770,568; 8,181,638; 8,469,013; and 8,739,769. Each of those patents is incorporated by reference as if fully set forth herein.

One or both of the mounting member 130 and the power cable pulley 150 are structurally arranged so as to enable substantially rigid attachment of the power cable pulley 150 to the mounting member 130 in any one of a set of multiple power cable pulley rotational positions. The set of multiple power cable pulley rotational positions defines a power cable pulley rotation axis 105 that is substantially parallel to the first pulley assembly axis 101; the power cable pulley rotation axis 105 typically is displaced from the first pulley assembly axis 101. The structural arrangement of the mounting member 130 and the power cable pulley 150 can be achieved in any suitable way. In the example in the drawings, two concentric arcuate slots 136 are formed in the mounting member 130 and a set of multiple threaded holes 156 are formed in the power cable pulley 150; any suitable numbers of slots 136 or holes 156 can be employed. Screws 126 are inserted through the slots 136, threaded into holes 156, and tightened to substantially rigidly attach the power cable pulley 150 to the mounting member 130. With the screws 126 loosened, the power cable pulley 150 can be moved among multiple power cable pulley rotational positions, and then secured in any selected one of those power cable pulley rotational positions by tightening the screws 126. The combination of slots 136, threaded holes 156, and screws 126 is only one example of attachment of the power cable pulley 150 to the mounting member 130; any other suitable structural arrangement for achieving substantially rigid attachment of the power cable pulley 150 to the mounting member 130 in any one of multiple power cable pulley rotational positions can be employed within the scope of the present disclosure or appended claims (e.g., sets of isolated holes in a circular pattern, or an axle or pivot arrangement).

In some examples (not shown), the mounting member 130 or the power cable pulley 150 can be arranged so that the set of multiple power cable pulley rotational positions is a continuous range of rotational positions about the power cable pulley rotation axis 105. In other examples, including the example shown in the drawings, the set of multiple power cable pulley rotational positions can comprise a set of discrete rotational positions of the power cable 150 about the power cable pulley rotation axis 105. In the example shown, one edge of the mounting member 130 has an array of twelve concave scallops 137. The power cable pulley 150 has a pin 157 that is received in one of the scallops 137 when the power cable pulley 150 is substantially rigidly attached to the mounting member 130 (by tightening the screws 126); if the pin 157 does not align with one of the scallops 137, the screws 126 cannot be fully tightened. As a result, the power cable pulley 150 can be attached to the mounting member 130 in any one of only twelve discrete rotational positions about the power cable pulley rotation axis 105. Aligning the pin 157 into one of the concave scallops 137 enables the mounting member 130 and the power cable pulley 150 to engage each other to provide mechanical indexing in each one of the twelve discrete rotational positions. The power cable pulley 150 or the mounting member 130 can be arranged to permit any desired number of discrete rotational positions of the power cable pulley 150 about the power cable pulley rotation axis 105. Any other suitable structural arrangement for providing mechanical indexing of the set of discrete rotational positions of the power cable pulley 150 can be employed within the scope of the present disclosure or appended claims (e.g., sets of isolated holes in a circular pattern, or a slotted or keyed axle).

Each different position in which the mounting member 130 is attached to the draw cable pulley 110 results in a corresponding different position for the power cable pulley rotation axis 105 relative to the first pulley assembly axis 101. The pulley assembly 100 can be arranged with the mounting member 130 and the power cable pulley 150 substantially rigidly attached in any desired combination of one of the mounting member positions and one of the power cable pulley rotational positions, respectively. For the example depicted in the drawings, three different discrete mounting member positions result in three different discrete positions of the power cable pulley rotation axis 105 relative to the first pulley assembly axis 101. Twelve different discrete power cable pulley rotational positions about the axis 105 result in thirty-six different combinations of those positions. Any other number of combinations of mounting member position and power cable pulley rotational position (or an effectively infinite number of combinations, in the case of a continuous range of positions) can be employed within the scope of the present disclosure or appended claims. A first example combination of mounting member and power cable pulley positions is shown in FIGS. 5A-5B, 11A, and 11B; a second example combination of mounting member and power cable pulley positions is shown in FIGS. 6A-6B, 12A, and 12B; a third example combination of mounting member and power cable pulley positions is shown in FIGS. 7A, 7B, 13A, and 13B. Differing draw force characteristics of the compound archery bow arise from the different positions of the power cable pulley rotation axis 105 (arising from the different positions of the mounting member 130 on the draw cable pulley 110) and the different rotational positions of the power cable pulley 150 about the axis 105.

Each combination of one of the mounting member positions and one of the power cable pulley rotational positions results in a corresponding dependence of the force exerted to draw the bow on to the distance the bow is drawn (i.e., the dependence of the draw force on the draw distance, also known as the draw force curve of the bow). The draw force curve can be characterized by, inter alia, a draw weight (i.e., the maximum force required during the draw), a draw length (i.e., a draw distance at which the draw force more or less abruptly reaches a local minimum draw force, referred to as let-off of the draw force), and an amount of stored energy of the drawn bow (i.e., the area under the draw force curve). Each combination of one of the mounting member positions and one of the power cable pulley rotational positions results in one or more of: (i) a corresponding draw length of the bow that differs from a draw length resulting from at least one different combination of mounting member position and power cable pulley rotational position; (ii) a corresponding draw weight of the bow that differs from a draw weight resulting from at least one different combination of mounting member position and power cable pulley rotational position; (iii) corresponding stored energy of the drawn bow that differs from stored energy of the drawn bow resulting from at least one different combination of mounting member position and power cable pulley rotational position; or (iv) a corresponding dependence of draw force on draw distance of the bow that differs from a dependence of draw force on draw distance resulting from at least one different combination of mounting member position and power cable pulley rotational position.

A method for adjusting the pulley assembly 100 therefore comprises: moving the mounting member 130 from a first one of the multiple mounting member positions and substantially rigidly attaching the mounting member 130 to the draw cable pulley 110 in a second, different one of the multiple mounting member positions; or moving the power cable pulley 150 from a first one of the multiple power cable pulley rotational positions and substantially rigidly attaching the power cable pulley 150 to the mounting member 130 in a second, different one of the multiple power cable pulley rotational positions. The movements of one or both of the mounting member 130 and the power cable pulley 150 alters one or more of the draw weight, the draw length, stored energy of the drawn bow, or the dependence of draw force on draw distance.

Figure 14:
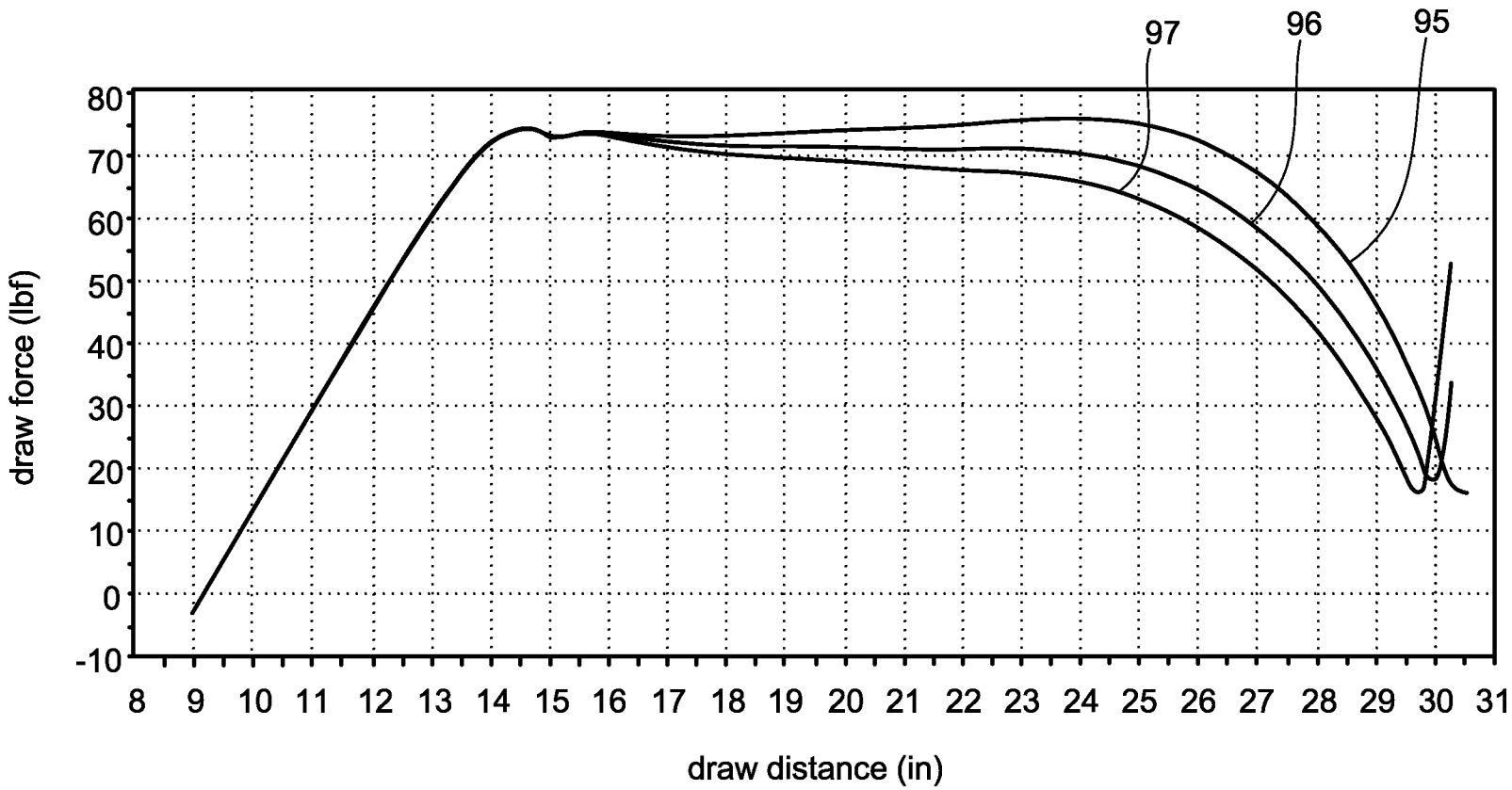
FIG. 14 is a plot of draw force versus draw distance (i.e., draw force curves) for a binary cam bow with pulley assemblies arranged as in FIGS. 5A and 5B, FIGS. 6A and 6B, and FIGS. 7A and 7B.

Movement of either or both of the mounting member 130 or the power cable pulley 150 can alter all aspects of the draw force curve. It has been generally observed, however, that movement of only the power cable pulley 150 about the axis 105 appears to affect primarily the draw length. Similarly, it has been generally observed that movement of the mounting member 130 on the draw cable pulley 110 (i.e., moving the power cable pulley axis 105 relative to the first pulley assembly axis 101) appears to affect primarily the draw weight or features of the draw force curve (e.g., the steepness or depth of the draw force let-off or the transition into a let-off region of the curve). Several examples of draw force curves are shown in FIG. 14 and correspond to the example arrangements of the mounting member 130 and the power cable pulley 150 shown in FIGS. 5A-5B, 11A, and 11B (curve 95), FIGS. 6A, 6B, 12A, and 12B (curve 96), and FIGS. 7A, 7B, 13A, and 13B (curve 97).

The pulley assembly 100 can further comprise a rotation stop 170 substantially rigidly attached to the draw cable pulley 110. The rotation stop 170 can be substantially rigidly attached to the draw cable pulley 110 in any one of a set of multiple rotation stop positions. In the examples shown the rotation stop 170 comprises a rigid post (typically cushioned or damped) attached to the draw cable pulley so that it impedes further rotation of the pulley assembly 100 when the post comes into contact with the power cable 31. Other suitable mechanical arrangements for implementing a rotation stop (e.g., a post arranged to collide with the bow limb 11) can be employed within the scope of the present disclosure or appended claims. Each rotation stop position corresponds to the draw lengths resulting from a corresponding one of the combinations of one of the mounting member positions and one of the power cable pulley rotational positions. A method for adjusting the pulley assembly 100 therefore comprises, after adjusting one or both of the mounting member 130 or the power cable pulley 150 to alter the draw length of the bow, moving the rotation stop 170 from a first one of the multiple rotation stop positions and substantially rigidly attaching the rotation stop 170 to the draw cable pulley 110 in a second, different one of the multiple rotation stop positions that corresponds to the altered draw length.

In examples wherein the mounting member 130 and the power cable pulley 150 can be moved only among sets of discrete positions, the set of multiple rotation stop positions also can comprise a set of discrete positions. In the examples shown, multiple threaded holes 172 formed in the draw cable pulley 110 are positioned at each desired rotation stop position. Each combination of one of the discrete positions of the mounting member 130 and one of the discrete rotational positions of the power cable pulley 150 corresponds to one of the discrete rotation stop positions. In the examples shown, thirty-six threaded holes 172 are formed in the draw cable pulley 110, and each one corresponds to the draw length arising from a corresponding one of the thirty-six combinations of mounting member position and power cable pulley rotational position.

As noted above, the disclosed inventive pulley assemblies can be employed with any type of compound archery bow, including dual cam, binary cam, solo cam, and hybrid cam bows. In dual or binary cam bows (FIGS. 1 and 2, respectively), the second pulley assembly 200 (rotatably mounted on limb 12) typically is substantially identical to or a substantial mirror image of the first pulley assembly 100 already described. The power cable 32 is taken up by the power cable pulley of the second pulley assembly 200 as the bow is drawn and the second pulley assembly 200 rotates about a corresponding second pulley assembly axis. The mounting member and power cable pulley of the second pulley assembly 200 can be adjusted in the same ways and with the same effect as disclosed above for the first pulley assembly 200. If the bow is a binary cam bow (FIG. 2), the pulley assemblies 100 and 200 each can further comprise a power cable let-out mechanism 180 substantially rigidly coupled to the draw cable pulley 110, the mounting member 130, or the power cable pulley 150. The power cable let-out mechanism 180 is structurally arranged to receive a corresponding one of the power cables and let out that power cable when the bow is drawn and the pulley assemblies 100 and 200 rotate.

If the bow is a solo cam bow (FIG. 3), the pulley assembly 100 can further comprise a draw cable let-out pulley 190 substantially rigidly coupled to the draw cable pulley 110, the mounting member 130, or the power cable pulley 150. The draw cable let-out pulley 190 is structurally arranged to receive a second end of the draw cable 30 in a circumferential draw cable journal and let out the second end of the draw cable, with the draw cable passing around an idler wheel (i.e., the second pulley assembly 200 rotatably mounted on the second bow limb 12) when the bow is drawn and the assemblies rotate about the corresponding pulley assembly axes. If the bow is a hybrid cam bow (FIG. 4), the pulley assembly 100 can be arranged similar to that of a solo cam bow, except that the cable received by and let out by the pulley 190 is an additional coupling cable 33 that is taken up by the second pulley assembly 200 as the bow is drawn.

Some examples of arrangements suitable for dual, binary, solo, or hybrid cam bows are disclosed in U.S. Pat. Nos. 7,305,979; 7,770,568; 8,181,638; 8,469,013; and 8,739,769. Each of those patents is incorporated by reference as if fully set forth herein.

In addition to the preceding, the following examples fall within the scope of the present disclosure or appended claims:

EXAMPLE 1

A pulley assembly for a compound archery bow, the pulley assembly comprising a draw cable pulley, a mounting member substantially rigidly attached to the draw cable pulley, and a power cable pulley substantially rigidly attached to the mounting member, wherein: the draw cable pulley is structurally arranged so as to (i) define a first pulley assembly transverse rotation axis, (ii) be mounted on a first limb of an archery bow to rotate about the first pulley assembly axis, (iii) receive a first end of a draw cable of the bow in a circumferential draw cable journal of the draw cable pulley, and (iv) let out the first end of the draw cable when the bow is drawn and the draw cable pulley rotates about the first pulley assembly axis; one or both of the draw cable pulley and the mounting member are structurally arranged so as to enable substantially rigid attachment of the mounting member to the draw cable pulley in any one of a set of multiple mounting member positions; one or both of the mounting member and the power cable pulley are structurally arranged so as to enable substantially rigid attachment of the power cable pulley to the mounting member in any one of a set of multiple power cable pulley rotational positions, and the set of multiple power cable pulley rotational positions defines a power cable pulley rotation axis substantially parallel to the first pulley assembly rotation axis; the power cable pulley member is structurally arranged so as to (i) receive a power cable of the bow in a circumferential power cable journal of the power cable pulley, and (ii) take up the power cable when the bow is drawn and the draw cable pulley rotates about the first pulley assembly axis; and each different position of the mounting member results in a corresponding different position of the power cable pulley rotation axis relative to the first pulley assembly rotation axis.

EXAMPLE 2

The pulley assembly of Example 1 wherein each combination of one of the mounting member positions and one of the power cable pulley rotational positions results in one or more of: (i) a corresponding draw length of the bow that differs from a draw length resulting from at least one different combination of mounting member position and power cable pulley rotational position; (ii) a corresponding draw weight of the bow that differs from a draw weight resulting from at least one different combination of mounting member position and power cable pulley rotational position; (iii) corresponding stored energy of the drawn bow that differs from stored energy of the drawn bow resulting from at least one different combination of mounting member position and power cable pulley rotational position; or (iv) a corresponding dependence of draw force on draw distance of the bow that differs from a dependence of draw force on draw distance resulting from at least one different combination of mounting member position and power cable pulley rotational position.

EXAMPLE 3

The pulley assembly of any preceding Example wherein each mounting member position results in a corresponding dependence of draw force on draw distance that differs from a dependence of draw force on draw distance resulting from at least one different mounting member position.

EXAMPLE 4

The pulley assembly of any preceding Example wherein each mounting member position results in a corresponding draw weight that differs from a draw weight resulting from at least one different mounting member position.

EXAMPLE 5

The pulley assembly of any preceding Example wherein each power cable pulley rotational position results in a corresponding draw length that differs from a draw length resulting from at least one different power cable pulley rotational position.

EXAMPLE 6

The pulley assembly of any preceding Example wherein the set of multiple mounting member positions comprises a set of discrete positions of the mounting member on the draw cable pulley.

EXAMPLE 7

The pulley assembly of Example 6 wherein one or both of the draw cable pulley and the mounting member are structurally arranged to engage each other to mechanically index each one of the discrete positions of the mounting member.

EXAMPLE 8

The pulley assembly of any preceding Example wherein the set of multiple power cable pulley rotational positions comprises a set of discrete rotational positions of the power cable pulley about the power cable pulley rotation axis.

EXAMPLE 9

The pulley assembly of Example 8 wherein one or both of the mounting member and the power cable pulley are structurally arranged to engage each other to mechanically index each one of the discrete rotational positions of the power cable pulley.

EXAMPLE 10

The pulley assembly of any preceding Example further comprising a rotation stop substantially rigidly attached to the draw cable pulley, wherein one or both of the draw cable pulley and the rotation stop are structurally arranged so as to enable substantially rigid attachment of the rotation stop to the first draw cable pulley in any one of a set of multiple rotation stop positions corresponding to the draw lengths resulting from corresponding combinations of one of the mounting member positions and one of the power cable pulley rotational positions.

EXAMPLE 11

The pulley assembly of Example 10 wherein: the set of multiple mounting member positions comprises a set of discrete positions of the mounting member on the draw cable pulley; the set of multiple power cable pulley rotational positions comprises a set of discrete rotational positions of the power cable pulley about the power cable pulley rotation axis; the set of multiple rotation stop positions comprises a set of discrete positions; and each combination of one of the discrete positions of the mounting member and one of the discrete rotational positions of the power cable pulley corresponds to one of the discrete rotation stop positions.

EXAMPLE 12

A method for adjusting the pulley assembly of Example 10 or 11, the method comprising: moving the mounting member from a first one of the multiple mounting member positions and substantially rigidly attaching the mounting member to the draw cable pulley in a second, different one of the multiple mounting member positions; or moving the power cable pulley from a first one of the multiple power cable pulley rotational positions and substantially rigidly attaching the power cable pulley to the mounting member in a second, different one of the multiple power cable pulley rotational positions, thereby altering the draw length of the bow, wherein the method further comprises moving the rotation stop from a first one of the multiple rotation stop positions and substantially rigidly attaching the rotation stop to the draw cable pulley in a second, different one of the multiple rotation stop positions that corresponds to the altered draw length.

EXAMPLE 13

The pulley assembly of any preceding Example wherein the pulley assembly further comprises a cable let-out pulley substantially rigidly attached to the draw cable pulley, the mounting member, or the power cable pulley, wherein the cable let-out pulley is structurally arranged so as to (i) receive an additional cable of the bow in a circumferential cable journal of the cable let-out pulley, and (ii) let out the additional cable when the bow is drawn and the draw cable pulley rotates about the first pulley assembly axis.

EXAMPLE 14

The pulley assembly of any preceding Example further comprising a second, similarly arranged pulley assembly.

EXAMPLE 15

A method for adjusting the pulley assembly of any preceding Example, the method comprising: moving the mounting member from a first one of the multiple mounting member positions and substantially rigidly attaching the mounting member to the draw cable pulley in a second, different one of the multiple mounting member positions; or moving the power cable pulley from a first one of the multiple power cable pulley rotational positions and substantially rigidly attaching the power cable pulley to the mounting member in a second, different one of the multiple power cable pulley rotational positions, thereby altering one or more of the draw weight, the draw length, the stored energy of the drawn bow, or the dependence of draw force on draw distance.

EXAMPLE 16

A compound archery bow, comprising: a central riser; first and second bow limbs secured to opposing ends of the riser; first and second pulley assemblies rotatably mounted on the first and second bow limbs, respectively; a draw cable; and a power cable, wherein the first pulley assembly comprises the pulley assembly of any preceding Example.

EXAMPLE 17

The bow of Example 16 further comprising a second power cable, wherein the second pulley assembly is arranged similarly to the first pulley assembly.

EXAMPLE 18

The bow of Example 17 wherein: the first pulley assembly further comprises a first power cable let-out pulley substantially rigidly attached to the first draw cable pulley, the first mounting member, or the first power cable pulley; the first power cable let-out pulley is structurally arranged so as to (i) receive the second power cable of the bow in a circumferential power cable journal of the first power cable let-out pulley, and (ii) let out the second power cable when the bow is drawn and the first draw cable pulley rotates about the first pulley assembly axis; the second pulley assembly further comprises a second power cable let-out pulley substantially rigidly attached to the second draw cable pulley, the second mounting member, or the second power cable pulley; and the second power cable let-out pulley is structurally arranged so as to (i) receive the first power cable of the bow in a circumferential power cable journal of the second power cable let-out pulley, and (ii) let out the first power cable when the bow is drawn and the second draw cable pulley rotates about the second pulley assembly axis.

EXAMPLE 19

The bow of Example 16 wherein the second pulley assembly includes a power cable let-out pulley that is structurally arranged so as to (i) receive the power cable in a circumferential power cable journal of the power cable let-out pulley, and (ii) let out the second power cable when the bow is drawn and the draw cable pulley rotates about the first pulley assembly axis.

EXAMPLE 20

The bow of Example 16 wherein: the first pulley assembly further comprises a draw cable let-out pulley substantially rigidly attached to the first draw cable pulley, the first mounting member, or the first power cable pulley; the second pulley assembly comprises an idler wheel; and the draw cable let-out pulley is structurally arranged so as to (i) receive a second end of the draw cable in a circumferential draw cable journal of the draw cable let-out pulley, and (ii) let out the second end of the draw cable, with the draw cable passing around the idler wheel, when the bow is drawn and the draw cable pulley rotates about the first pulley assembly axis.

EXAMPLE 21

The bow of Example 16 further comprising a coupling cable, wherein: the first pulley assembly further comprises a coupling cable let-out pulley substantially rigidly attached to the first draw cable pulley, the first mounting member, or the first power cable pulley; the second pulley assembly comprises a second draw cable pulley and a coupling cable take-up pulley; the second draw cable pulley is structurally arranged so as to (i) receive a second end of the draw cable in a circumferential draw cable journal of the second draw cable pulley, and (ii) let out the second end of the draw cable when the bow is drawn and the second pulley assembly rotates about the second pulley assembly axis; the coupling cable take-up pulley is structurally arranged so as to (i) receive a first end of the coupling cable in a circumferential coupling cable journal of the coupling cable take-up pulley, and (ii) take up the first end of the coupling cable when the bow is drawn and the second pulley assembly rotates about the second pulley assembly axis; and the coupling cable let-out pulley is structurally arranged so as to (i) receive a second end of the coupling cable in a circumferential coupling cable journal of the coupling cable let-out pulley, and (ii) let out the second end of the coupling cable when the bow is drawn and the first draw cable pulley rotates about the first pulley assembly axis.

EXAMPLE 22

A method for adjusting the bow of any preceding Example, the method comprising: moving the first mounting member from a first one of the multiple mounting member positions and substantially rigidly attaching the first mounting member to the first draw cable pulley in a second, different one of the multiple mounting member positions; or moving the first power cable pulley from a first one of the multiple power cable pulley rotational positions and substantially rigidly attaching the first power cable pulley to the first mounting member in a second, different one of the multiple power cable pulley rotational positions, thereby altering one or more of the draw weight, the draw length, the stored energy of the drawn bow, or the dependence of draw force on draw distance.

EXAMPLE 23

The method of Example 22 wherein each mounting member position results in a corresponding dependence of draw force on draw distance that differs from a dependence of draw force on draw distance resulting from at least one different mounting member position.

EXAMPLE 24

The method of Example 23 wherein each mounting member position results in a corresponding draw weight that differs from a draw weight resulting from at least one different mounting member position.

EXAMPLE 25

The method of Example 22 wherein each power cable pulley rotational position results in a corresponding draw length that differs from a draw length resulting from at least one different power cable pulley rotational position.

EXAMPLE 26

The method of any preceding Example method for adjusting the bow of any preceding Example that includes a rotation stop, the method comprising: moving the first mounting member from a first one of the multiple mounting member positions and substantially rigidly attaching the first mounting member to the first draw cable pulley in a second, different one of the multiple mounting member positions; or moving the first power cable pulley from a first one of the multiple power cable pulley rotational positions and substantially rigidly attaching the first power cable pulley to the first mounting member in a second, different one of the multiple power cable pulley rotational positions, thereby altering the draw length of the bow, wherein the method further comprises moving the first rotation stop from a first one of the multiple rotation stop positions and substantially rigidly attaching the first rotation stop to the first draw cable pulley in a second, different one of the multiple rotation stop positions that corresponds to the altered draw length.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶6 are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A pulley assembly for a compound archery bow, the pulley assembly comprising a draw cable pulley, a mounting member substantially rigidly attached to the draw cable pulley, and a power cable pulley substantially rigidly attached to the mounting member, wherein:

the draw cable pulley is structurally arranged so as to (i) define a first pulley assembly transverse rotation axis, (ii) be mounted on a first limb of an archery bow to rotate about the first pulley assembly axis, (iii) receive a first end of a draw cable of the bow in a circumferential draw cable journal of the draw cable pulley, and (iv) let out the first end of the draw cable when the bow is drawn and the draw cable pulley rotates about the first pulley assembly axis;

one or both of the draw cable pulley and the mounting member are structurally arranged so as to enable substantially rigid attachment of the mounting member to the draw cable pulley in any one of a set of multiple mounting member positions;

one or both of the mounting member and the power cable pulley are structurally arranged so as to enable substantially rigid attachment of the power cable pulley to the mounting member in any one of a set of multiple power cable pulley rotational positions, and the set of multiple power cable pulley rotational positions defines a power cable pulley rotation axis substantially parallel to the first pulley assembly rotation axis;

the power cable pulley member is structurally arranged so as to (i) receive a power cable of the bow in a circumferential power cable journal of the power cable pulley, and (ii) take up the power cable when the bow is drawn and the draw cable pulley rotates about the first pulley assembly axis; and each different position of the mounting member results in a corresponding different position of the power cable pulley rotation axis relative to the first pulley assembly rotation axis.

2. The pulley assembly of claim 1 wherein each combination of one of the mounting member positions and one of the power cable pulley rotational positions results in one or more of: (i) a corresponding draw length of the bow that differs from a draw length resulting from at least one different combination of mounting member position and power cable pulley rotational position; (ii) a corresponding draw weight of the bow that differs from a draw weight resulting from at least one different combination of mounting member position and power cable pulley rotational position; (iii) corresponding stored energy of the drawn bow that differs from stored energy of the drawn bow resulting from at least one different combination of mounting member position and power cable pulley rotational position; or (iv) a corresponding dependence of draw force on draw distance of the bow that differs from a dependence of draw force on draw distance resulting from at least one different combination of mounting member position and power cable pulley rotational position.

3. A method for adjusting the pulley assembly of claim 2, the method comprising:

moving the mounting member from a first one of the multiple mounting member positions and substantially rigidly attaching the mounting member to the draw cable pulley in a second, different one of the multiple mounting member positions; or moving the power cable pulley from a first one of the multiple power cable pulley rotational positions and substantially rigidly attaching the power cable pulley to the mounting member in a second, different one of the multiple power cable pulley rotational positions, thereby altering one or more of the draw weight, the draw length, the stored energy of the drawn bow, or the dependence of draw force on draw distance.

4. The pulley assembly of claim 2 wherein each mounting member position results in a corresponding draw weight that differs from a draw weight resulting from at least one different mounting member position.

5. The pulley assembly of claim 2 further comprising a rotation stop substantially rigidly attached to the draw cable pulley, wherein one or both of the draw cable pulley and the rotation stop are structurally arranged so as to enable substantially rigid attachment of the rotation stop to the first draw cable pulley in any one of a set of multiple rotation stop positions corresponding to the draw lengths resulting from corresponding combinations of one of the mounting member positions and one of the power cable pulley rotational positions.

6. A method for adjusting the pulley assembly of claim 5, the method comprising:

moving the mounting member from a first one of the multiple mounting member positions and substantially rigidly attaching the mounting member to the draw cable pulley in a second, different one of the multiple mounting member positions; or moving the power cable pulley from a first one of the multiple power cable pulley rotational positions and substantially rigidly attaching the power cable pulley to the mounting member in a second, different one of the multiple power cable pulley rotational positions, thereby altering the draw length of the bow, wherein the method further comprises moving the rotation stop from a first one of the multiple rotation stop positions and substantially rigidly attaching the rotation stop to the draw cable pulley in a second, different one of the multiple rotation stop positions that corresponds to the altered draw length.

7. The pulley assembly of claim 5 wherein:

the set of multiple mounting member positions comprises a set of discrete positions of the mounting member on the draw cable pulley;

the set of multiple power cable pulley rotational positions comprises a set of discrete rotational positions of the power cable pulley about the power cable pulley rotation axis;

the set of multiple rotation stop positions comprises a set of discrete positions; and each combination of one of the discrete positions of the mounting member and one of the discrete rotational positions of the power cable pulley corresponds to one of the discrete rotation stop positions.

8. The pulley assembly of claim 1 wherein the set of multiple mounting member positions comprises a set of discrete positions of the mounting member on the draw cable pulley.

9. The pulley assembly of claim 8 wherein one or both of the draw cable pulley and the mounting member are structurally arranged to engage each other to mechanically index each one of the discrete positions of the mounting member.

10. The pulley assembly of claim 1 wherein the set of multiple power cable pulley rotational positions comprises a set of discrete rotational positions of the power cable pulley about the power cable pulley rotation axis.

11. The pulley assembly of claim 10 wherein one or both of the mounting member and the power cable pulley are structurally arranged to engage each other to mechanically index each one of the discrete rotational positions of the power cable pulley.

12. The pulley assembly of claim 1 further comprising a second pulley assembly, wherein:

the second pulley assembly comprises a second draw cable pulley, a second mounting member substantially rigidly attached to the second draw cable pulley, and a second power cable pulley substantially rigidly attached to the second mounting member;

the second draw cable pulley is structurally arranged so as to (i) define a second pulley assembly transverse rotation axis substantially parallel to the first pulley assembly axis, (ii) be mounted on a second limb of an archery bow to rotate about the second pulley assembly axis, (iii) receive a second end of the draw cable of the bow in a circumferential draw cable journal of the second draw cable pulley, and (iv) let out the second end of the draw cable when the bow is drawn and the second draw cable pulley rotates about the second pulley assembly axis;

one or both of the second draw cable pulley and the second mounting member are structurally arranged so as to enable substantially rigid attachment of the second mounting member to the second draw cable pulley in any one of a second set of multiple mounting member positions;

one or both of the second mounting member and the second power cable pulley are structurally arranged so as to enable substantially rigid attachment of the second power cable pulley to the second mounting member in any one of a second set of multiple power cable pulley rotational positions, and the second set of multiple power cable pulley rotational positions defines a second power cable pulley rotation axis substantially parallel to the second pulley assembly rotation axis;

the second power cable pulley member is structurally arranged so as to (i) receive a second power cable of the bow in a circumferential power cable journal of the second power cable pulley, and (ii) take up the second power cable when the bow is drawn and the second draw cable pulley rotates about the second pulley assembly axis; and each different position of the second mounting member results in a corresponding different position of the second power cable pulley rotation axis relative to the second pulley assembly rotation axis.

13. The pulley assembly of claim 1 wherein the pulley assembly further comprises a cable let-out pulley substantially rigidly attached to the draw cable pulley, the mounting member, or the power cable pulley, wherein the cable let-out pulley is structurally arranged so as to (i) receive an additional cable of the bow in a circumferential cable journal of the cable let-out pulley, and (ii) let out the additional cable when the bow is drawn and the draw cable pulley rotates about the first pulley assembly axis.

14. A compound archery bow, comprising:

a central riser;

first and second bow limbs secured to opposing ends of the riser;

first and second pulley assemblies rotatably mounted on the first and second bow limbs, respectively;

a draw cable; and a power cable, wherein:

the first pulley assembly comprises a first draw cable pulley, a first mounting member substantially rigidly attached to the first draw cable pulley, and a first power cable pulley substantially rigidly attached to the first mounting member;

the first draw cable pulley is structurally arranged so as to (i) define a first pulley assembly transverse rotation axis, (ii) be mounted on the first limb of the bow to rotate about the first pulley assembly axis, (iii) receive a first end of the draw cable in a circumferential draw cable journal of the first draw cable pulley, and (iv) let out the first end of the draw cable when the bow is drawn and the first draw cable pulley rotates about the first pulley assembly axis;

one or both of the first draw cable pulley and the first mounting member are structurally arranged so as to enable substantially rigid attachment of the first mounting member to the first draw cable pulley in any one of a first set of multiple mounting member positions;

one or both of the first mounting member and the first power cable pulley are structurally arranged so as to enable substantially rigid attachment of the first power cable pulley to the first mounting member in any one of a first set of multiple power cable pulley rotational positions, and the first set of multiple power cable pulley rotational positions defines a first power cable pulley rotation axis substantially parallel to the first pulley assembly rotation axis;

the first power cable pulley member is structurally arranged so as to (i) receive the power cable in a circumferential power cable journal of the first power cable pulley, and (ii) take up the power cable when the bow is drawn and the first draw cable pulley rotates about the first pulley assembly axis; and each different mounting member position results in a corresponding different position of the power cable pulley rotation axis relative to the first pulley assembly rotation axis.

15. The bow of claim 14 wherein each combination of one of the mounting member positions and one of the power cable pulley rotational positions results in one or more of: (i) a corresponding draw length of the bow that differs from a draw length resulting from at least one different combination of mounting member position and power cable pulley rotational position; (ii) a corresponding draw weight of the bow that differs from a draw weight resulting from at least one different combination of mounting member position and power cable pulley rotational position; (iii) corresponding stored energy of the drawn bow that differs from stored energy of the drawn bow resulting from at least one different combination of mounting member position and power cable pulley rotational position; or (iv) a corresponding dependence of draw force on draw distance of the bow that differs from a dependence of draw force on draw distance resulting from at least one different combination of mounting member position and power cable pulley rotational position.

16. A method for adjusting the bow of claim 15, the method comprising:

moving the first mounting member from a first one of the multiple mounting member positions and substantially rigidly attaching the first mounting member to the first draw cable pulley in a second, different one of the multiple mounting member positions; or moving the first power cable pulley from a first one of the multiple power cable pulley rotational positions and substantially rigidly attaching the first power cable pulley to the first mounting member in a second, different one of the multiple power cable pulley rotational positions, thereby altering one or more of the draw weight, the draw length, the stored energy of the drawn bow, or the dependence of draw force on draw distance.

17. The bow of claim 15 wherein each mounting member position results in a corresponding draw weight that differs from a draw weight resulting from at least one different mounting member position.

18. The bow of claim 15 further comprising a first rotation stop substantially rigidly attached to the first draw cable pulley, wherein one or both of the first draw cable pulley and the first rotation stop are structurally arranged so as to enable substantially rigid attachment of the first rotation stop in any one of a first set of multiple rotation stop positions corresponding to the draw lengths resulting from corresponding combinations of one of the mounting member positions and one of the power cable pulley rotational positions.

19. A method for adjusting the bow of claim 18, the method comprising:

moving the first mounting member from a first one of the multiple mounting member positions and substantially rigidly attaching the first mounting member to the first draw cable pulley in a second, different one of the multiple mounting member positions; or moving the first power cable pulley from a first one of the multiple power cable pulley rotational positions and substantially rigidly attaching the first power cable pulley to the first mounting member in a second, different one of the multiple power cable pulley rotational positions, thereby altering the draw length of the bow, wherein the method further comprises moving the first rotation stop from a first one of the multiple rotation stop positions and substantially rigidly attaching the first rotation stop to the first draw cable pulley in a second, different one of the multiple rotation stop positions that corresponds to the altered draw length.

20. The bow of claim 18 wherein:

the first set of multiple mounting member positions comprises a set of discrete positions of the first mounting member on the first draw cable pulley;

the first set of multiple power cable pulley rotational positions comprises a set of discrete rotational positions of the first power cable pulley about the first power cable pulley rotation axis;

the first set of multiple rotation stop positions comprises a set of discrete positions; and each combination of one of the discrete positions of the first mounting member and one of the discrete rotational positions of the first power cable pulley corresponds to one of the discrete positions of the first rotation stop.

21. The bow of claim 14 wherein the first set of multiple mounting member positions comprises a set of discrete positions of the first mounting member on the first draw cable pulley.

22. The bow of claim 21 wherein one or both of the first draw cable pulley and the first mounting member are structurally arranged to engage each other to mechanically index each one of the discrete positions of the first mounting member.

23. The bow of claim 14 wherein the first set of multiple power cable pulley rotational positions comprises a set of discrete rotational positions of the first power cable pulley about the first power cable pulley rotation axis.

24. The bow of claim 23 wherein one or both of the first mounting member and the first power cable pulley are structurally arranged to engage each other to mechanically index each one of the discrete rotational positions of the first power cable pulley.

25. The bow of claim 14 further comprising a second power cable, wherein:

the second pulley assembly comprises a second draw cable pulley, a second mounting member substantially rigidly attached to the second draw cable pulley, and a second power cable pulley substantially rigidly attached to the second mounting member;

the second draw cable pulley is structurally arranged so as to (i) define a second pulley assembly transverse rotation axis substantially parallel to the first pulley assembly axis, (ii) be mounted on the second limb of the bow to rotate about the second pulley assembly axis, (iii) receive a second end of the draw cable in a circumferential draw cable journal of the second draw cable pulley, and (iv) let out the second end of the draw cable when the bow is drawn and the second draw cable pulley rotates about the second pulley assembly axis;

one or both of the second draw cable pulley and the second mounting member are structurally arranged so as to enable substantially rigid attachment of the second mounting member to the second draw cable pulley in any one of a second set of multiple mounting member positions;

one or both of the second mounting member and the second power cable pulley are structurally arranged so as to enable substantially rigid attachment of the second power cable pulley to the second mounting member in any one of a second set of multiple power cable pulley rotational positions, and the second set of multiple power cable pulley rotational positions defines a second power cable pulley rotation axis substantially parallel to the second pulley assembly rotation axis;

the second power cable pulley member is structurally arranged so as to (i) receive the second power cable of the bow in a circumferential power cable journal of the second power cable pulley, and (ii) take up the second power cable when the bow is drawn and the second draw cable pulley rotates about the second pulley assembly axis; and each different position of the second mounting member results in a corresponding different position of the second power cable pulley rotation axis relative to the second pulley assembly rotation axis.

26. The bow of claim 25 wherein:

the first pulley assembly further comprises a first power cable let-out pulley substantially rigidly attached to the first draw cable pulley, the first mounting member, or the first power cable pulley;

the first power cable let-out pulley is structurally arranged so as to (i) receive the second power cable of the bow in a circumferential power cable journal of the first power cable let-out pulley, and (ii) let out the second power cable when the bow is drawn and the first draw cable pulley rotates about the first pulley assembly axis;

the second pulley assembly further comprises a second power cable let-out pulley substantially rigidly attached to the second draw cable pulley, the second mounting member, or the second power cable pulley; and the second power cable let-out pulley is structurally arranged so as to (i) receive the first power cable of the bow in a circumferential power cable journal of the second power cable let-out pulley, and (ii) let out the first power cable when the bow is drawn and the second draw cable pulley rotates about the second pulley assembly axis.

27. The bow of claim 14 wherein the second pulley assembly includes a power cable let-out pulley that is structurally arranged so as to (i) receive the power cable in a circumferential power cable journal of the power cable let-out pulley, and (ii) let out the second power cable when the bow is drawn and the draw cable pulley rotates about the first pulley assembly axis.

28. The bow of claim 14 wherein:

the first pulley assembly further comprises a draw cable let-out pulley substantially rigidly attached to the first draw cable pulley, the first mounting member, or the first power cable pulley;

the second pulley assembly comprises an idler wheel; and the draw cable let-out pulley is structurally arranged so as to (i) receive a second end of the draw cable in a circumferential draw cable journal of the draw cable let-out pulley, and (ii) let out the second end of the draw cable, with the draw cable passing around the idler wheel, when the bow is drawn and the draw cable pulley rotates about the first pulley assembly axis.

29. The bow of claim 14 further comprising a coupling cable, wherein:

the first pulley assembly further comprises a coupling cable let-out pulley substantially rigidly attached to the first draw cable pulley, the first mounting member, or the first power cable pulley;

the second pulley assembly comprises a second draw cable pulley and a coupling cable take-up pulley;

the second draw cable pulley is structurally arranged so as to (i) receive a second end of the draw cable in a circumferential draw cable journal of the second draw cable pulley, and (ii) let out the second end of the draw cable when the bow is drawn and the second pulley assembly rotates about the second pulley assembly axis;

the coupling cable take-up pulley is structurally arranged so as to (i) receive a first end of the coupling cable in a circumferential coupling cable journal of the coupling cable take-up pulley, and (ii) take up the first end of the coupling cable when the bow is drawn and the second pulley assembly rotates about the second pulley assembly axis; and the coupling cable let-out pulley is structurally arranged so as to (i) receive a second end of the coupling cable in a circumferential coupling cable journal of the coupling cable let-out pulley, and (ii) let out the second end of the coupling cable when the bow is drawn and the first draw cable pulley rotates about the first pulley assembly axis.

* * * * *